US005906239A

United States Patent [19]

Oettli

[11] Patent Number: 5,906,239

[45] Date of Patent: May 25, 1999

[54] JARRING TOOL

[75] Inventor: Mark C. Oettli, Erie, Pa.

[73] Assignee: IRI International Corporation, Houston, Tex.

[21] Appl. No.: 08/827,794

[22] Filed: Apr. 11, 1997

[51] Int. Cl.[6] ..... E21B 31/107

[52] U.S. Cl. ..... 166/178; 175/320; 175/321; 175/297

[58] Field of Search ..... 175/296, 297, 175/320, 319, 321, 152, 191, 374, 386, 387; 166/178

[56] References Cited

U.S. PATENT DOCUMENTS

| | | | |
|---|---|---|---|
| 2,721,056 | 10/1955 | Storm | 175/297 |
| 2,819,876 | 1/1958 | Ransom | 255/27 |
| 3,063,501 | 11/1962 | Britton | 166/178 |
| 3,239,017 | 3/1966 | Hazen et al. | 175/296 |
| 3,285,353 | 11/1966 | Young | 175/297 |
| 3,392,795 | 7/1968 | Greer | 175/297 |
| 3,570,612 | 3/1971 | Slator | 175/297 |
| 3,606,297 | 9/1971 | Webb | 267/125 |
| 3,735,827 | 5/1973 | Berryman | 175/296 |
| 3,735,828 | 5/1973 | Berryman | 175/299 |
| 3,797,591 | 3/1974 | Berryman | 175/296 |
| 3,804,185 | 4/1974 | Mason | 175/297 |
| 3,851,717 | 12/1974 | Berryman | 175/297 |
| 3,898,815 | 8/1975 | Young | 64/23.7 |
| 3,949,821 | 4/1976 | Raugust | 175/297 |
| 3,955,634 | 5/1976 | Slator et al. | 175/297 |
| 3,987,858 | 10/1976 | Slator et al. | 175/297 |
| 4,023,630 | 5/1977 | Perkin et al. | 175/297 |
| 4,161,224 | 7/1979 | Hostrup | 175/297 |
| 4,186,807 | 2/1980 | Sutliff et al. | 175/302 |
| 4,196,782 | 4/1980 | Blanton | 175/297 |
| 4,200,158 | 4/1980 | Perkins | 175/297 |
| 4,210,214 | 7/1980 | Blanton | 175/297 |
| 4,331,006 | 5/1982 | Bishop | 464/18 |
| 4,439,167 | 3/1984 | Bishop et al. | 464/20 |
| 4,511,007 | 4/1985 | Jung et al. | 175/297 |
| 4,566,546 | 1/1986 | Evans | 175/297 |
| 4,658,917 | 4/1987 | Ring | 175/297 |
| 4,662,460 | 5/1987 | Loeb et al. | 175/305 |

(List continued on next page.)

OTHER PUBLICATIONS

"Instruction Manual Bowen Jar Intensifiers," Manual No. 5/4019, Bowen Tools, Inc., Jul. 1984. (19 pages).

"Bumper sub, jar accelerator, combination drilling jar," DES/Griffith, *Classified Index of Products & Services in the 37th ( 1986–87 ) Revision of Composite Catalog,* p. 1693.

"H–E Accelerator," Houston Engineers, Inc, *Classified Index of Products & Services in the 37th ( 1986–87 ) Revision of Composite Catalog,* pp. 2704–2705.

*Primary Examiner*—Roger Schoeppel

*Attorney, Agent, or Firm*—Akin, Gump, Strauss, Hauer & Feld, L.L.P.

[57] ABSTRACT

A dual acting hydraulic jarring tool which includes dual acting metering devices and is particularly well suited for coiled tubing application. A common annular chamber is formed between reciprocating cylindrical assemblies and dual engaging and metering devices are used to engage and meter hydraulic fluid at a predetermined rate flowing from one chamber to another chamber defined within the annular space. An improved retarding and metering mechanism is also disclosed which serves to retard relative telescoping movement of one cylindrical assembly relative to the other cylindrical assembly and meter the hydraulic fluid at the predetermined rate. The present invention is particularly well suited for coiled tubing application due to its low load requirements, minimal overall length and enlarged interior bore for the passage of downhole tools; however, the present invention is well suited for use with conventional drilling strings as well.

61 Claims, 10 Drawing Sheets

U.S. PATENT DOCUMENTS

| | | | |
|---|---|---|---|
| 4,844,183 | 7/1989 | Evans | 175/296 |
| 4,846,273 | 7/1989 | Anderson et al. | 166/178 |
| 4,865,125 | 9/1989 | De Cuir | 166/178 |
| 5,007,479 | 4/1991 | Pleasants et al. | 166/178 |
| 5,033,557 | 7/1991 | Askew | 175/297 |
| 5,066,060 | 11/1991 | Cooksey et al. | 294/86.18 |
| 5,069,282 | 12/1991 | Taylor | 166/301 |
| 5,086,853 | 2/1992 | Evans | 175/297 |
| 5,174,393 | 12/1992 | Roberts et al. | 166/178 X |
| 5,232,060 | 8/1993 | Evans | 175/297 |
| 5,425,430 | 6/1995 | Roberts | 175/296 |
| 5,431,221 | 7/1995 | Roberts et al. | 166/73 |
| 5,447,196 | 9/1995 | Roberts | 166/178 |
| 5,584,353 | 12/1996 | Chancey et al. | 175/297 |

FIG. 2
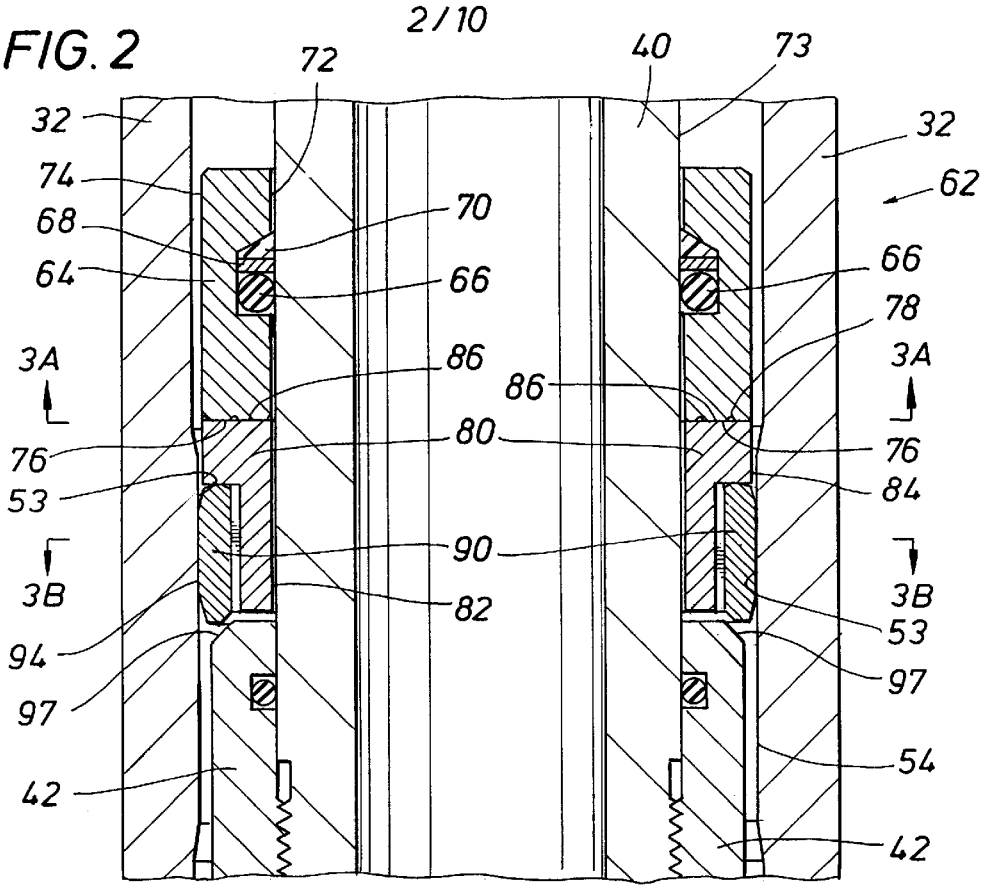
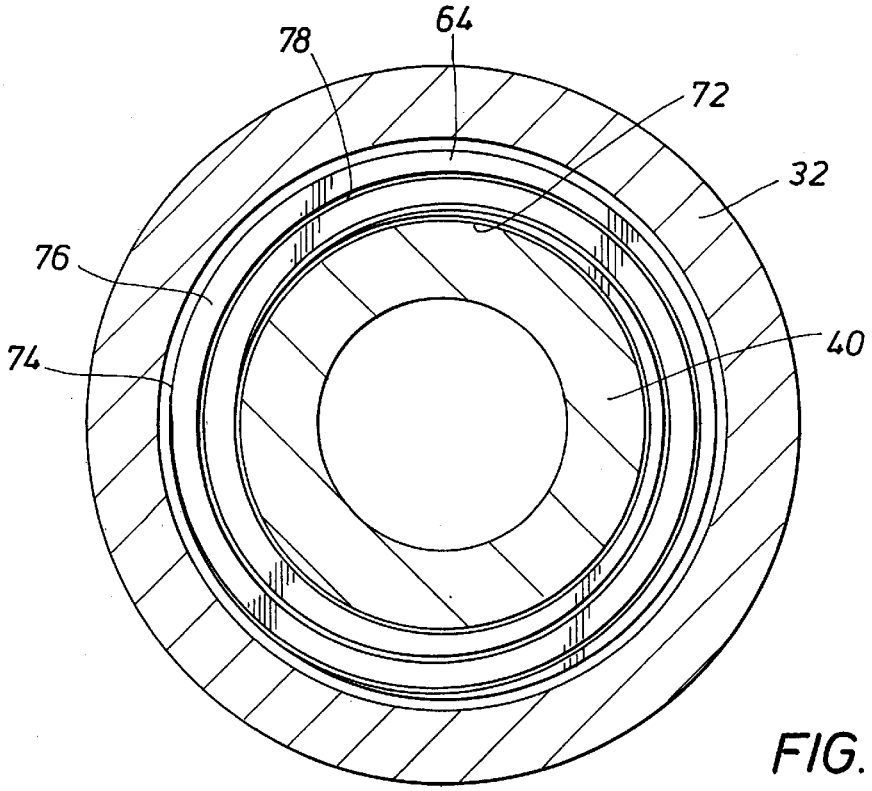
FIG. 3A

FIG. 6
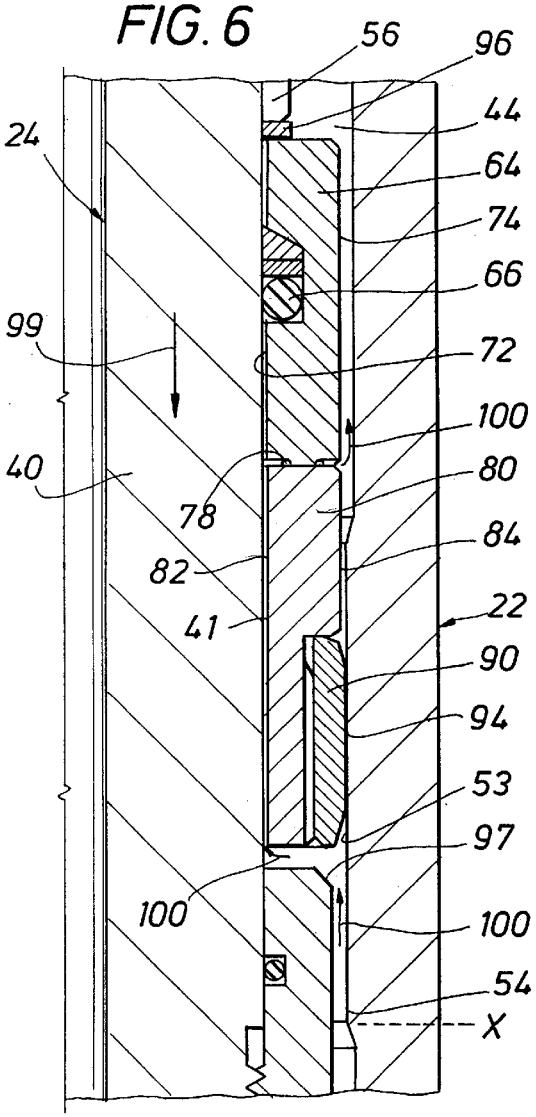
FIG. 7
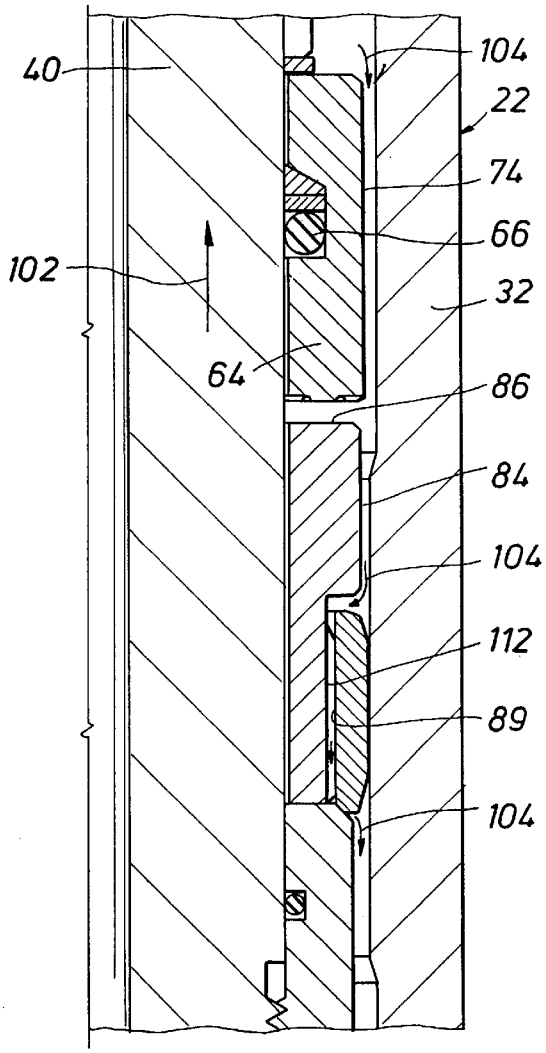
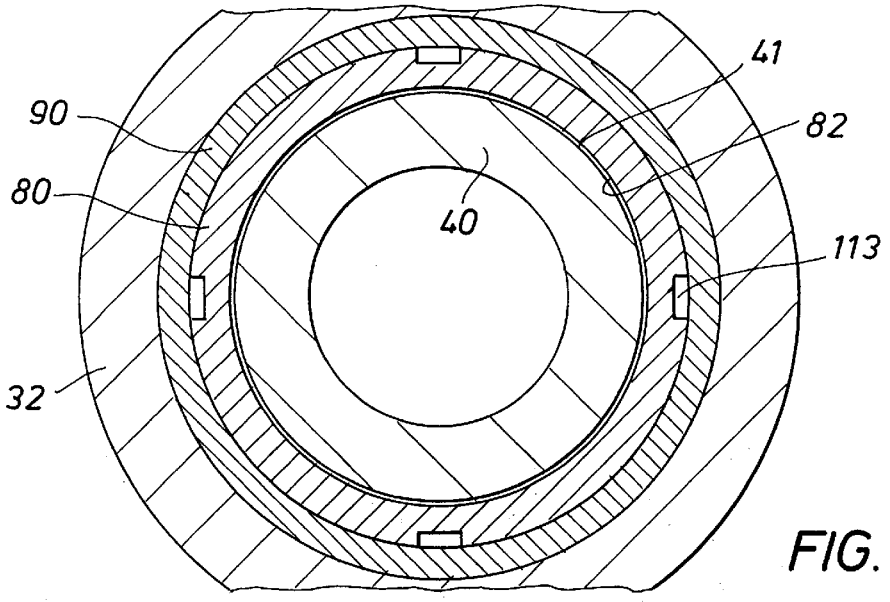
FIG. 3B

FIG. 4
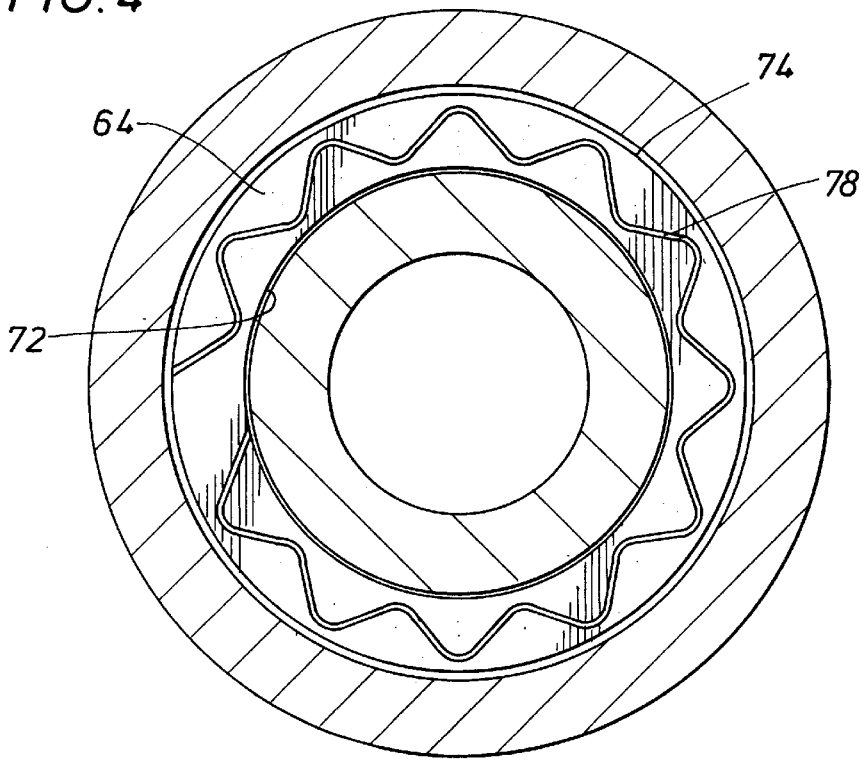
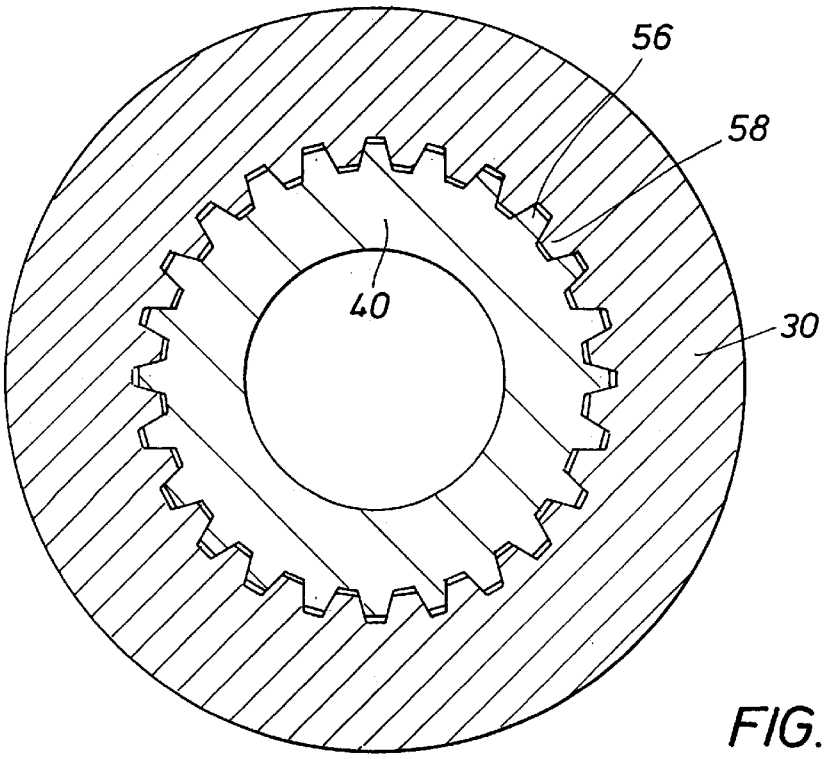
FIG. 5

JARRING TOOL

BACKGROUND OF THE INVENTION

1. Field of the Invention

The present invention relates to a well jarring tool used to free stuck pipe within a well bore. More particularly, the present invention relates to a double acting hydraulic well jar useful in coiled tubing and conventional drilling applications which includes a metering system to establish a predetermined timing sequence prior to applying either an upward or downward jarring action.

2. Description of the Related Art

Jarring tools are used to free stuck drill pipe or well tools in a well bore. They provide a substantial upward or downward jarring action in an effort to transmit sufficient force to dislodge a stuck member. Double acting jars which can transmit either upward or downward jarring loads are well known in the prior art. See, for example, U.S. Pat. Nos. 4,186,807; 4,865,125; and 5,007,479. Such jars typically use a hydraulic-type fluid to isolate well bore pressure and provide the working fluid through which the jarring tool operates.

With the advent of coiled tubing techniques, the need exists for a variety of downhole tools capable of performing their traditional functions but in the confines of a coiled tubing application. Briefly, a coiled tubing operation involves the use of a single continuous pipe or tubing for drilling application rather than the more traditional 30-foot drill pipe sections. The tubing, which is coiled onto a reel and uncoiled as it is lowered into the well bore, can be used for either drilling or workover applications. However, coiled tubing presents a number of working constraints to existing tool design. First of all, due to the limited size of the coiled tubing, limited compressive loads can be placed on the tubing by the rig operator. Essentially, this means that downhole tools which require compressive force to operate, such as a jarring tool, must be capable of operating with the limited compressive load capability of coiled tubing. In addition, in coiled tubing application the overall length of the downhole tool becomes significant since there is limited distance available between the stuffing box and the blowout preventor to accommodate the bottom hole assembly. A typically bottom hole assembly might include a quick disconnect, a sinker bar located below the quick disconnect to provide weight to the bottom hole assembly, the jarring tool, a release tool below that of some type, and then an overshot. There may be other tools as well which may be needed. Thus, the length of the jarring tool itself becomes particularly significant since the entire bottom hole assembly must fit within the limited distance between the stuffing box and blowout preventor to introduce it into a pressurized well. Furthermore, within these confines, the jarring tool must have a large enough internal bore to permit pump-down tools to pass. Thus, the coiled-tubing jarring tool must have a limited overall wall thickness in view of limited outer diameter conditions.

As in the case of traditional drill pipe, coiled tubing or other down hole tools may get stuck in the well bore at times. Under these circumstances, repetitive upjarring or downjarring with a jarring tool is particularly advantageous. Thus, the need exists for a double acting hydraulic jarring tool which can satisfy the limited compressive load, limited length and large bore requirements of coiled tubing application as mentioned above but which also employs a metering principle to provide sufficient time for the operator to prepare for an upjarring or downjarring activity and provide for multiple jarring applications. Preferably, such a jarring tool design would have application in a conventional drill string as well.

SUMMARY OF THE INVENTION

Briefly, the present invention is a well jar having inner and outer overlapping, telescopingly related cylindrical assemblies or tubular members which move longitudinally relative to one another. Because of their overlapping nature, an annular space or chamber is formed between the inner and outer cylindrical assemblies. Longitudinal splines are provided on both cylindrical assemblies which are slidably engaged in an interlocking fit that permit longitudinal movement yet prevent relative rotational movement. Upper and lower annular seals are preferably provided which seal off the annular space from the well bore. The present invention includes a restricting member in the annular space generally proximate each end of the annular space and a corresponding engaging and metering device proximate each restricting member to engage that restricting member dividing the annular space into two chambers and permitting the metering of hydraulic fluid past the point of engagement. In this manner, metering is provided in both an upjarring and downjarring mode.

Each engaging and metering device may comprise a first annular member and an adjacent second annular member positioned within the annular space. Each annular member has an inner radial surface, an outer radial surface and a face plane at one end of each annular member between the edges of the inner and outer radial surfaces. The metering device also includes means for fluid communication between the inner and outer radial surfaces of one annular member. Preferably, such a fluid communication means comprises a groove etched or machined on the face plane of one annular member and extending from its inner radial edge to its outer radial edge to meter the flow of fluid within the annular space. Once the face plane of the first member contacts the face plane of the second member a seal is formed. The second annular member also includes a contact surface. A ring is positioned within the annular space adjacent the contact surface of the second annular member and is adapted to contact the restricting member in a predetermined direction only to provide a sufficient retarding mechanism to keep the outer cylindrical assembly from moving relative to the inner cylindrical assembly as hydraulic fluid meters through the groove.

The longitudinal displacement of the first restricting member and its length, relative to the second restricting member is predetermined so as to render the second engaging and metering member inactive when it passes the second restricting member due to its one way operational mode when the first engaging and metering member engages the first restricting member and meters fluid permitting activity in an upjarring mode only, for example. Similarly, placement of the second restricting member relative to the first restricting member permits the first engaging and metering device to remain inactive when it passes the first restricting member when the second engaging and metering device engages the second restricting member and meters fluid permitting activity in a downjarring mode only, for example. In this manner, repetitive upjarring or downjarring may be performed with the use of a single annular space but without the use of springs or other mechanical compressive or tensile elements and with a minimal amount of compressive load as described below which is necessary in a coiled tubing application.

The present invention also comprises a metering mechanism to monitor fluid flowing from one chamber to another chamber between corresponding inner and outer cylindrical assemblies. This metering mechanism comprises a first annular member positioned within the annular space having inner and outer radial surfaces and a face plane therebetween at one end, and a correspondingly displaced second annular member also having inner and outer radial surfaces with a face plane therebetween. The face plane of the first annular member includes a groove which extends from the inner to the outer radial surfaces. The configuration and length of the groove is selected so as to control the amount of fluid flowing from one side of the metering mechanism to the other or from one chamber to another chamber of the annular space. Preferably, the groove would be spiral or serpentine in configuration and of a predetermined width, depth and length providing for a preferred flow rate.

Additionally, the present invention includes a preferred engaging and metering device which comprises the metering mechanism referred to in the preceding paragraph and a ring or cone positioned adjacent the second annular member. The ring has a contact surface adapted to contact a contact surface of the second annular member generally distal the face plane of the second annular member. In this manner, once the ring contacts a restricted surface or restricting member, such as an upset portion of the outer cylindrical assembly, the contact surface of the ring seals against the contact surface of the second annular member providing a seal and serving to further retard the relative movement of the inner and outer cylindrical assemblies while the hydraulic fluid flows from one side of the metering mechanism to the other through the groove.

While the present invention has been described in terms of a coiled tubing application principally, it should be understood that the elements of the present invention have equal application as a jarring tool for freeing conventional drill strings and downhole tools that are stuck in the well.

Examples of the more important features of this invention have been summarized rather broadly in order that the detailed description may be better understood. There are, of course, additional features of the invention which will be described hereinafter and which will also form the subject of the claims appended hereto.

BRIEF DESCRIPTION OF THE DRAWINGS

FIG. 2 is an enhanced detail view of the present invention taken along line 2—2 of FIG. 1B.

FIG. 3A is a cross-sectional view of the present invention taken along line 3A—3A of FIG. 2.

FIG. 3B is a cross-sectional view of the present invention taken along line 3B—3B of FIG. 2.

FIG. 4 is an alternate embodiment of the groove configuration of the present invention as shown in FIG. 3A.

FIG. 5 is a cross-sectional view of the present invention taken along line 5—5 of FIG. 1B.

FIG. 6 is an enhanced detail view of the present invention as shown in FIG. 2 but in an operational mode.

FIG. 7 is another enhanced detail view of the present invention as shown in FIG. 2 but in an operational mode.

DETAILED DESCRIPTION OF THE PREFERRED EMBODIMENT

Figure 1A:
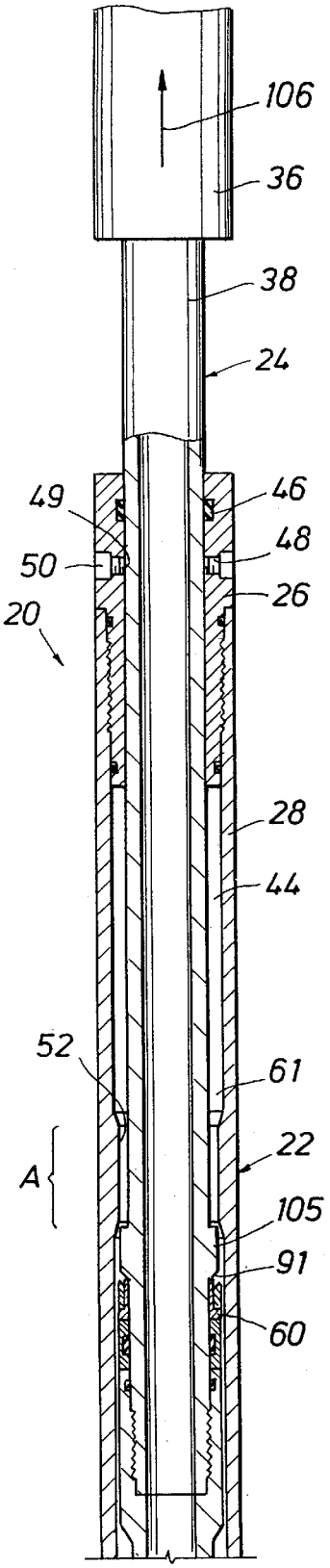
FIGS. 1A–1C are detailed fragmented vertical cross-sectional views of the present invention.

Referring to FIGS. 1A–1C and 2–7, the present invention is a well jarring tool 20 comprising an outer cylindrical assembly or tubular member 22 and an inner cylindrical assembly or tubular member 24. Typically, outer cylindrical assembly or tubular member 22 comprises a mandrel body 26 threadably engaged to an upper pressure body 28 which is threadably engaged to a connector body 30 which is threadably engaged to a lower pressure body 32 which is threadably engaged to a wash pipe 34. Typically, inner cylindrical assembly or tubular member 24 comprises a top sub 36 attached to a mandrel 38 which is threadably engaged to a mandrel extension 40 which is threadably engaged to a wash pipe 42. As shown, each such threaded connection typically includes one or two o-rings to create a sealed connection across the threads preventing pressure loss.

Figure 1B:
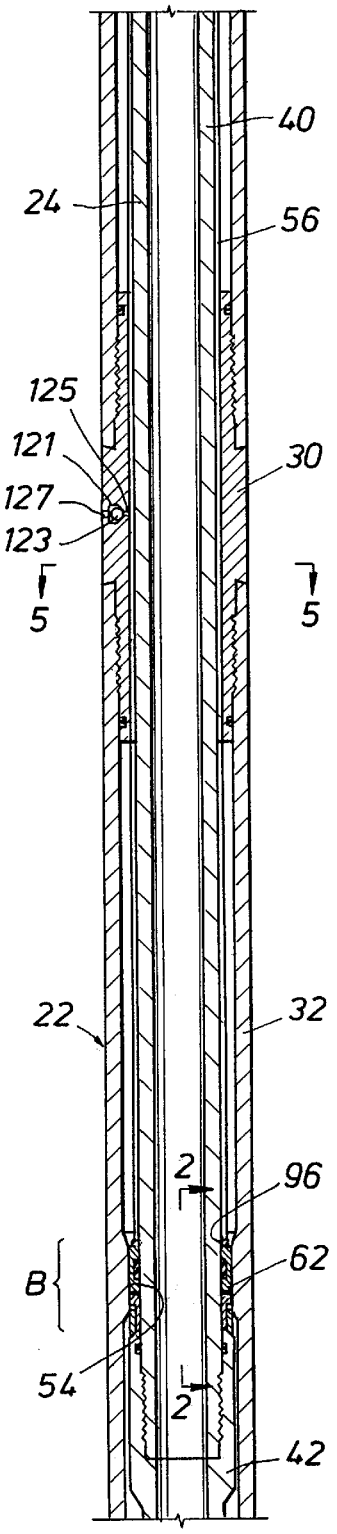
Figure 1C:
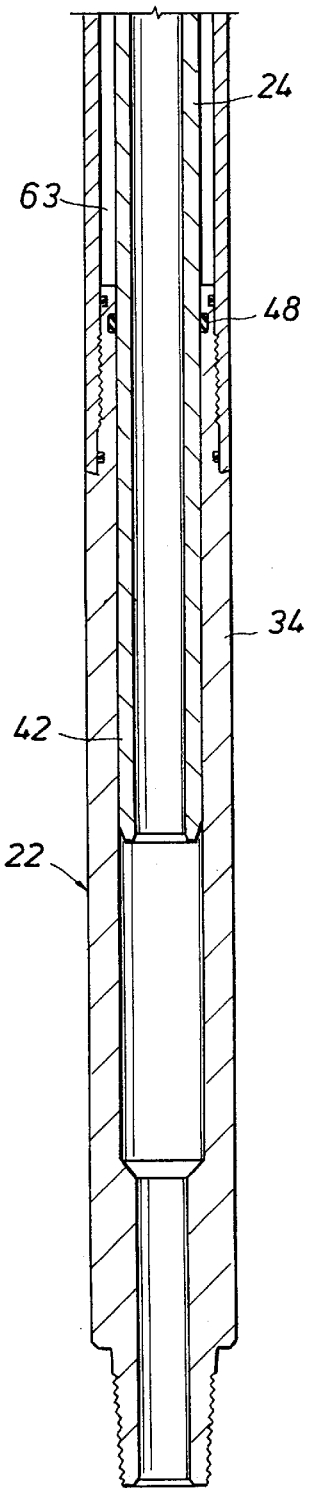

Referring to FIGS. 1A–1C in particular, the telescoping placement of inner cylindrical assembly 24 within outer cylindrical assembly 22 defines an annular space 44 which is sealed at the top or upper end thereof by a seal 46 and at the bottom or lower end thereof by a seal 48. In this manner, any hydraulic fluid or other medium within chamber 44 is isolated from the effects of hydrostatic pressure or well bore pressure. The hydraulic fluid within chamber 44 may be supplemented or replaced through fill outlet 49. A threadable plug 50 is used to seal off any hydraulic fluid within chamber 44. The type of hydraulic fluid or other fluid could be used in annular chamber 44 is well known to those skilled in the art and may be, for example, a light weight oil or like noncompressible fluid.

Referring still to FIGS. 1A–1C, outer cylindrical assembly 22 and in particular upper pressure body 28 includes a restricting member or upset portion 52. Similarly, lower pressure body 32 includes a restricting member or upset portion 54. Both upset portions 52 and 54 may be thickened wall sections of corresponding upper pressure body 28 and lower pressure body 32 which reduce the overall cross-sectional area of annular chamber 44 within regions "A" and "B", respectively.

Referring now to FIG. 5 in combination with FIG. 1B, mandrel extension 40 includes splines 56 which are interspersed circumferentially around mandrel extension 40. Similarly, connector body 30 includes corresponding splines 58 which interlock in a meshing manner as shown in FIG. 5 with splines 56. In this manner, relative longitudinal movement of outer cylindrical assembly 22 and inner cylindrical assembly 24 is permitted but relative rotational movement between outer cylindrical assembly 22 and inner cylindrical assembly 24 is prohibited. Thus, any torquing, downhole motor drilling activity or rotary drilling activity may continue to occur through the jarring tool.

Referring now to FIGS. 2 and 3A–3C in combination with FIGS. 1A–1C, the present invention also includes an engaging and metering device 60 adapted to engage or contact upset portion 52 and meter hydraulic fluid when inner cylindrical assembly 24 is advancing in an upward direction. By engaging upset portion 52, device 60 divides annular space 44 into an upper chamber 61 and a lower chamber 63. Upper chamber 61 extends from device 60 to seal 46. Lower chamber 63 extends from device 60 to seal 48. The invention also includes engaging and metering device 62 adapted to engage upset portion 54 when inner cylindrical assembly 24 is advancing in a downward direction. Once again, when device 62 engages upset portion 54, annular space 44 is divided into an upper chamber which extends from device 62 to seal 46 and a lower chamber which extends from device 62 to seal 48. As discussed herein, device 60 is inactive when moving in a downward mode while device 62 is inactive when moving in an upward mode. Thus, annular space 44 will be divided into two different sets of upper and lower chambers depending on whether device 60 or device 62 is activated engaging its respective upset portion. Referring still to FIG. 1B, a one-way pressure relief valve 121 may be included which permits the release of pressure from chamber 63 (as shown) to the exterior of outer cylindrical assembly 22. Valve 121 is shown using a ball 123 sealed against aperture 125 by a spring (not shown). When the pressure in chamber 63 exceeds the load of the spring, the ball is unseated off aperture 125 and pressure is released through apertures 125 and 127 to the exterior of outer assembly 22. Pressure relief valve 121 is optional and would likely only be used in "hot hole" application when it is anticipated the temperature of the hydraulic fluid in chambers 61 or 63 will increase significantly due to downhole conditions and thereby build-up excessive pressure in chambers 61 or 63.

Referring now to FIG. 2 in particular, the operation of engaging and metering device 62 will be described in more detail. The operation of engaging and metering device 60 is identical to that of engaging and metering device 62 as shown in FIG. 2 except that it operates in the reverse direction. Device 62 includes an annular member or seal body 64 positioned within annular space 44. A seal 66 with an adjacent seal protector ring 68 is positioned within a recessed portion 70 of seal body 64. Seal 66 prevents passage of fluid between the inner radial surface 72 of seal body 64 and the outer surface 73 of mandrel extension 40. Occasionally, inner radial surface 72 will be referred to as inner edge 72 of seal body 64. Seal body 64 also includes an outer radial surface 74 which will be referred to as outer edge 74. A face surface or face plane 76 is defined between inner edge 72 and outer edge 74 of seal body 64.

Referring to FIG. 3A, a groove 78 is etched or machined on face plane 76. The groove extends from inner edge 72 to outer edge 74 of seal body 64. Groove 78 serves to meter the flow of hydraulic fluid as discussed below. In coiled tubing application the size of a jarring tool is limited in size, for example to diameters of about 3.125 inches or less. In such instances, groove 78 is preferably a spiral configuration as shown in FIG. 3A, whose radius increases gradually outwardly from inner edge 72 to outer edge 74. A spiral cut has been found preferable in coiled tubing application because it optimizes the amount of length possible on annular face plane 76 which may only have a ¼"–¾" difference between inner and outer radii. By providing a longer longitudinal groove, the width and/or depth of groove 78 may be larger as well which is beneficial as discussed below. Traditionally, a metering groove may be a straight-line radial cut only ¼"–¾" in length because that is the distance from the inner edge 72 to the outer edge 74 of seal body 64. To provide slow enough metering at the anticipated pressures with such a small length groove requires an exceedingly small width and/or depth of the groove. This is disadvantageous because such a groove has a tendency to become easily clogged or plugged during operation. Based on anticipated pressures and the kinematic viscosity of the fluids used, a fluid flow rate of between about 0.003 gallons per minute and 0.007 gallons per minute is optimal for a smaller coiled tubing jarring tools of the present invention having an outer diameter of approximately 1 13/16 inches, a fluid flow rate of between about 0.0046 gallons per minute and 0.0092 gallons per minute is optimal for medium size coiled tubing jarring tools of the present invention having an outer diameter of approximately 2⅛ inches, and a fluid flow rate of between about 0.0125 gallons per minute and 0.0250 gallons per minute is optimal for larger coiled tubing jarring tools of the present invention having an outer diameter of approximately 3⅛ inches. In such applications and in accordance with the present invention, it has been found preferable to use a spiral-shaped groove because of the limited distances available in coiled tubing application. If a groove is used having a length of at least five inches, the low flow rates can still be achieved with a groove width or depth larger than 0.003 inches. Tests have shown that widths or depths of less than 0.003 inches tend to clog more easily; however, a single groove of at least five inches in length permits a width or depth of groove larger than 0.003 inches. Thus, the preferable length of groove 78 in coiled tubing applications of the present invention is at least about five inches. More preferably, it is between about five and about ten inches in length, and most preferably it is between about six and about seven inches in length for the smaller sized jarring tools of the present invention used in coiled tubing application. Similarly, the width or depth of the groove is preferably at least about 0.003 inches, more preferably between about 0.003 inches and about 0.010 inches and most preferably between about 0.003 inches and about 0.004 inches. Groove 78 need not be spiral in configuration to perform according to the present invention. For example, any configuration which provides adequate length thereby permitting a wide or deep enough gap is acceptable. Referring to FIG. 4, groove 78 is alternatively shown in a serpentine configuration extending from inner edge 72 to outer edge 74.

As noted above, the present invention has been described principally in terms of coiled tubing application wherein a groove of spiral configuration is preferable in view of the limited geometry available. However, when the present invention is used in a conventional drilling application using a standard drill string, it may not be necessary that the groove have a spiral configuration because there may be enough distance between the inner and outer radii of seal body 64 to provide sufficient length not to require a spiral or serpentine configuration. For example, in such event the necessary metering may be achieved through one or more straight line radial cuts between the inner and outer radii and along face 76 of seal body 64.

Figure 3C:
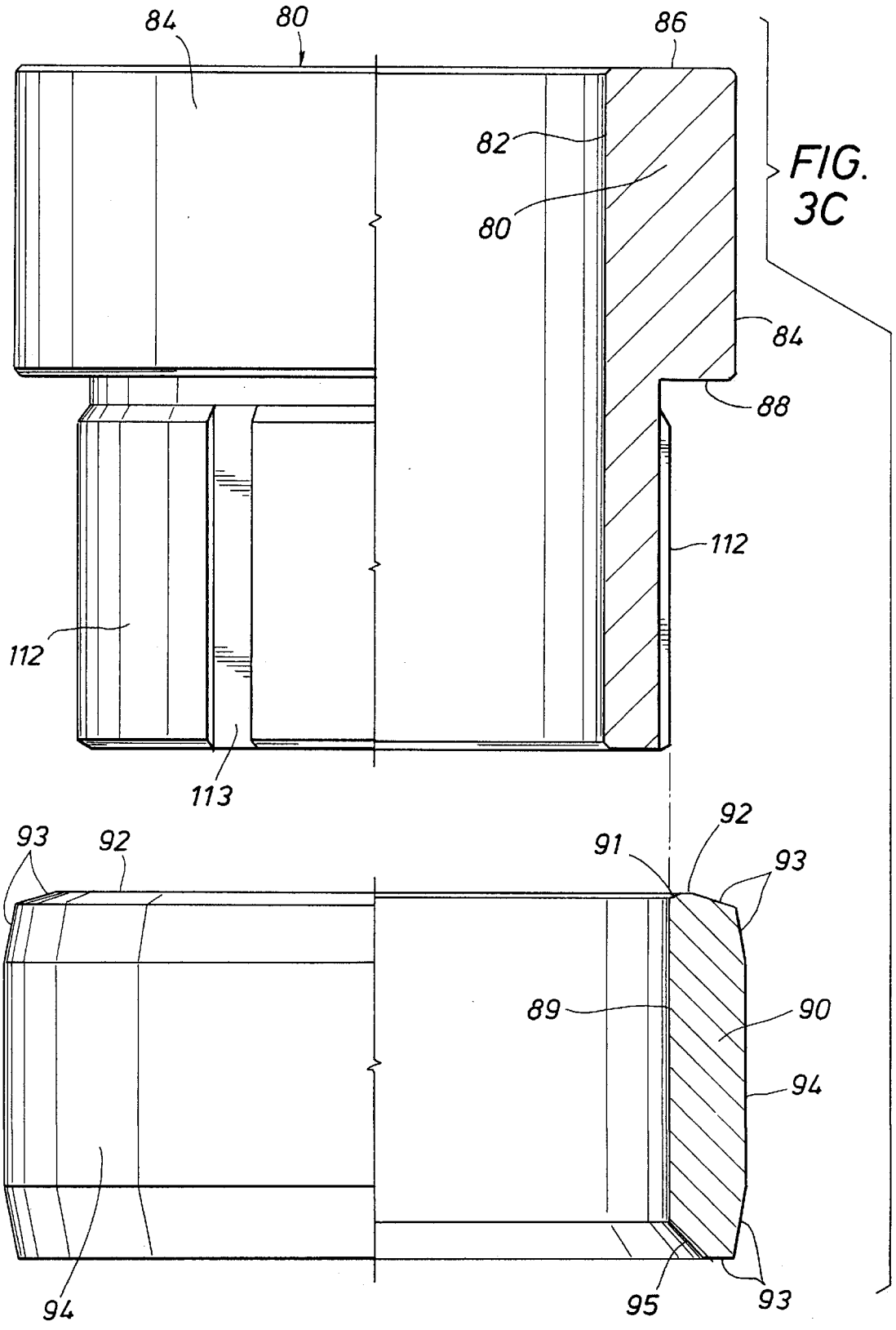
FIG. 3C is an enhanced detail view, partly in section, of a portion of the present invention.

Referring to FIGS. 2 and 3C in conjunction with FIGS. 1A–1C, the engaging and metering device 62 also comprises annular member 80 referred to occasionally as cone body 80. Annular member or cone body 80 also includes an inner radial surface 82 which will also be referred to as inner edge 82, an outer radial surface 84 which will also be referred to as outer edge 84, a face plate or face plane 86 between inner edge 82 and outer edge 84, and a contact surface 88. In operation, face plane 86 is adapted to contact face plane 76 of seal body 64 thereby only permitting the transfer of fluid in accordance with the present invention as described below from inner edge 82 to outer edge 84 through groove 78, which acts as the metering conduit. Obviously, groove 78 may be etched or machined on face plane 86 of cone body 80 rather than face plane 76 of seal body 64 and still function identically. Device 62 also includes a ring or cone 90 having inner edges 89 and 91 including a contact surface 92. Ring 90 also has a series of outer edges 93 including outer surface 94. Further, ring 90 also includes a second contact surface 95.

Referring still to FIGS. 2 and 3C in combination with FIGS. 1A–1C and 6, device 62 is restrained longitudinally by splines 56 at one end and wash pipe 42 at its other end. A washer 96 (FIG. 6) serves to distribute contact stresses between seal body 64 and splines 56. With reference to FIG. 1B, device 62 is adapted to retard downward movement of inner cylindrical assembly 24 relative to outer cylindrical assembly 22 as region "B" of cylindrical assembly 22 or upset portion 54 engages ring 90 as described in more detail below. Device 62 will not retard upward relative motion between cylindrical assemblies 22 and 24 nor will it meter when device 62 moves upwardly relative to outer cylindrical assembly 22. Rather, device 60 will retard upward movement of inner cylindrical assembly 24 relative to outer cylindrical assembly 22 as device 60 engages region "A" of upset portion 52. This operation is described in more detail below with reference to FIGS. 6 and 7 and still later with reference to FIGS. 10A–10C, 11A–11C, and 12A–12C.

Device 60 is identical in configuration to device 62 as shown in FIG. 2 and discussed above except that it retards relative upward movement between inner cylindrical assembly 24 and outer cylindrical assembly 22 and provides metering in accordance with the invention as disclosed below when inner cylindrical assembly 24 moves upwardly relative to outer cylindrical assembly 22 as shown in FIG. 1A.

Referring now to FIGS. 6, 7 and 3B–3C, the operation of device 62 is shown in more detail. As noted above, engaging and metering devices 60 and 62 serve to divide annular chamber 44 into upper and lower chambers when each device is active. The operational sequence of the present invention will be described in further detail below with reference to FIGS. 8A–8C, 9A–9C, 10A–10C, 11A–11C, and 12A–12C. However, before that discussion, it may be helpful to explain further how engaging and metering devices 60 and 62 operate.

Referring to FIGS. 6 and 3B–3C, inner cylindrical assembly 24 is being advanced downwardly relative to outer cylindrical assembly 22 in the direction of arrow 99. As noted above, device 62 is positioned within annular space 44 and is retained longitudinally adjacent mandrel extension 40 by splines 56 at one end and wash pipe 42 at its other end. Hydraulic fluid completely fills chamber 44 and is isolated from the well bore by seals 46 and 48 (see FIGS. 1A–1C). As inner cylindrical assembly 24 moves downwardly relative to outer cylindrical assembly 22 (as may occur when the rig operator begins to exert a compressive force on the drill string), device 62 advances downwardly with mandrel extension 40. Outer surface 94 of ring or cone 90 begins to contact surface 53 of upset portion 54. This occurs because the outer diameter of ring 90 at surface 94 is slightly larger than the inner diameter of surface 53 so that an interference fit is initially created. As such, ring 90 slides upwardly. Once initial contact is made between surface 94 of ring 90 and surface 53 of upset portion 54, ring 90 slows down until its contact surface 92 engages contact surface 88 of cone body 80. While surfaces 88 and 92 are shown substantially coplanar, they may not necessarily have to be so long as a seal is provided. Ring 90 is preferably made of a soft metal such as copper or brass which serves to encourage a tight seal. Surface 92 of ring 90 may plasticly deform in providing the seal, which is acceptable. As downward movement in the direction of arrow 99 continues and the seal between surfaces 88 and 92 is established, a pressure differential results across the seal of surfaces 88 and 92 because the fluid moving generally upwardly in the direction of arrow 100 can no longer pass across the seal. This pressure differential serves to further push surface 94 of ring 90 radially outwardly slightly thereby further engaging or gripping surface 53 of upset portion 54. This action serves to substantially stop or significantly slow down relative movement in the direction 99 between inner cylindrical assembly 24 and outer cylindrical assembly 22. As the operator continues to exert a downward compressive force on inner cylindrical assembly 24, hydraulic fluid flows in the direction of arrow 100. Since it cannot pass around ring 90, it is deviated between ring 90 and surface 97 radially inwardly and migrates between inner edge 82 of cone body 80 and outer surface 41 of mandrel extension 40 until it reaches seal 66. It is then forced within groove 78 since face planes 76 and 86 are in tight contact otherwise, and the metering process begins. As hydraulic fluid migrates through groove 78, it exits at the top of face planes 76 and 86 proximate outer edges 74 of seal body 64 and outer edge 84 of cone body 80. As this metering of hydraulic fluid occurs through groove 78, device 62 and inner cylindrical assembly 24 advances downwardly in the direction of arrow 99 until such point as planar surface 94 of ring 90 reaches the end of upset portion 54 as shown as line "X" in FIG. 6. At that point, planar surface 94 of ring is no longer in contact with surface 53 of upset portion 54. Ring 90 cannot slide out striking the inside surface of lower pressure body 32 because it is in a ring configuration. Thus, inner cylindrical assembly 24 is immediately released relative to outer cylindrical 22 and the initiation of a downward jarring blow, as will be discussed in more detail below, occurs.

Referring to FIGS. 7 and 3B–3C, the upward movement of device 62 and cylindrical assembly 24 in the direction of arrow 102 is shown relative to outer cylindrical assembly 22. However, in this operational mode device 62 does not retard movement of inner cylindrical assembly 24 relative to outer cylindrical assembly 22 and does not meter hydraulic fluid. This is also referred to occasionally herein as the inactive position of device 62. Referring still to FIGS. 7 and 3B–3C, hydraulic fluid flows in the direction of arrow 104 when device 62 is inactive. That is, it flows between the outer edge 74 of seal body 64, outer edge 84 of cone body 80 and the inner surface of lower pressure body 32. When the fluid reaches ring 90 it passes around ring 90 in between surfaces 88 and 92 (see FIG. 3C) and surface 89 of ring 90 and surface 112 of cone body 80, preferably along slots 113. The fluid then continues downwardly as shown in FIG. 7 and along slots (not shown) formed within surface 97 of wash pipe 42. Seal body 64 is shown in the same position in FIG. 7 as in FIG. 6 because seal 66 will keep body 64 seated against washer 96 due to the frictional force of seal 66 against mandrel extension 40.

Referring still to FIGS. 6 and 7, device 62 is shown in the active position (FIG. 6) retarding longitudinal movement of inner cylindrical assembly 24 relative to outer cylindrical assembly 22 and metering fluid through groove 78. Additionally, device 62 is shown in the inactive position (FIG. 7) not retarding relative longitudinal movement between inner and outer cylindrical assemblies 24/22 and permitting the free flow of hydraulic fluid in the direction of arrows 104 as shown.

Figure 8A:
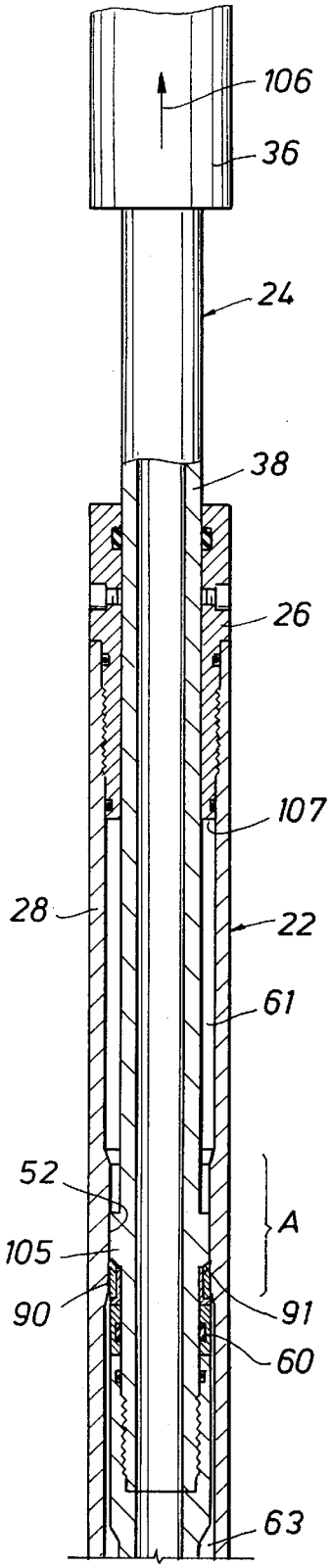
FIGS. 8A–8C are detailed fragmented vertical cross-sectional views of the present invention shown moving towards an upjar.
Figure 8B:
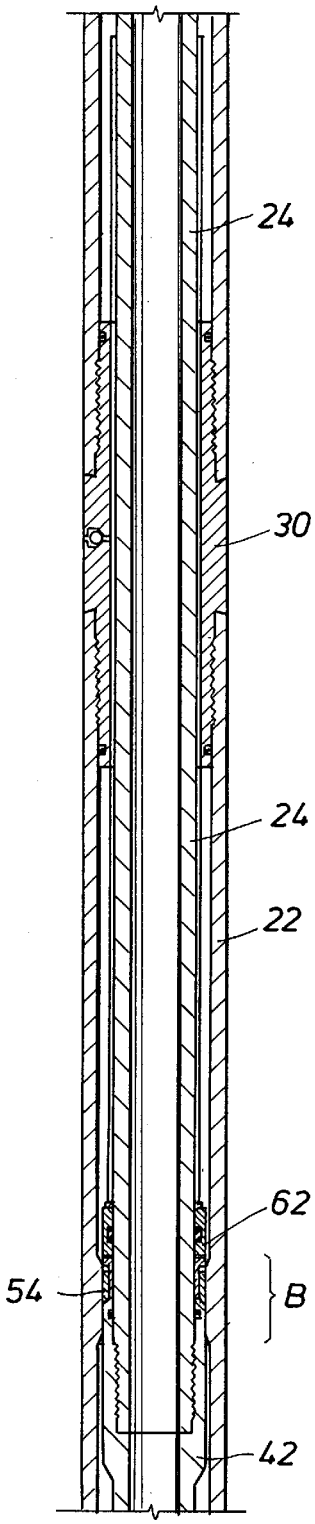
Figure 8C:
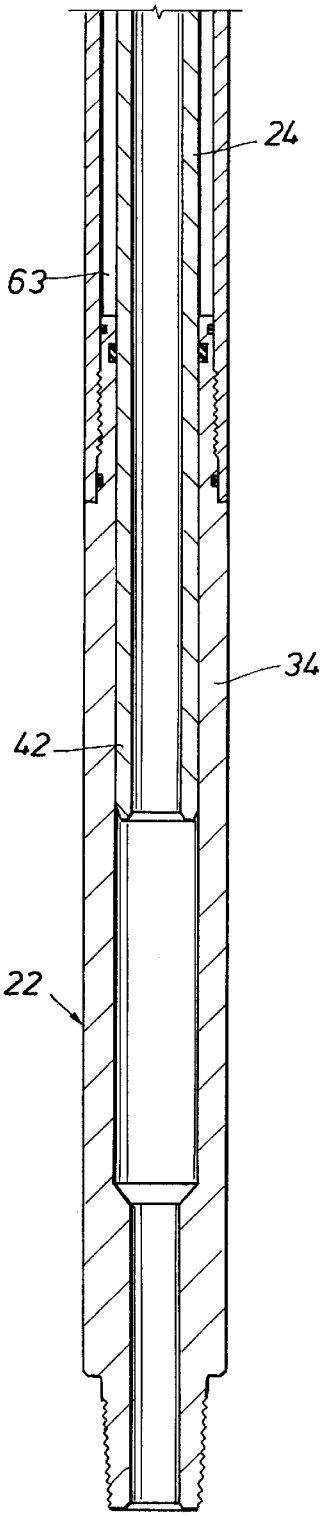

Engaging and metering device 60 (see FIG. 1A) operates in an identical manner as that shown in FIGS. 6 and 7 for device 62 except that cone body 80 is located above seal body 64 and when inactive, ring 90 moves freely between surface 88 of cone body 80 and surface 91 of protrusion 105 of mandrel 38. Otherwise, device 60 is identical in structure and operation since ring 90 and cone body 80 are located above seal body 64. The operational aspect particularly with respect to the orientation of the inner and outer cylindrical assemblies are also identical to that shown in FIGS. 6 and 7. The reader simply has to invert FIGS. 6 and 7 to illustrate the operation of device 60. In this regard, metering device 60 serves to retard movement of inner cylindrical assembly 24 as it moves upwardly relative to outer cylindrical assembly 22 in the direction of arrow 106 (see FIG. 1A). If FIG. 6 is inverted, arrow 99 will coincide with the direction of arrow 106. In this respect, ring 90 will engage region "A" of upset portion 52 as inner cylindrical assembly 24 or mandrel 38 is pulled upwardly in the direction of arrow 106 (FIG. 8A). This tensile load is introduced by the drilling rig operator. Once contact is made between ring 90 and upset portion 52, upward movement of inner cylindrical assembly 24 relative to outer cylindrical assembly 22 substantially stops or is significantly reduced. Further tensile load in the direction of arrow 106 will cause the hydraulic fluid to flow in the direction of arrow 100 (as shown by FIG. 6 but inverting the figure) bypassing ring 90 and advancing under inner edge 82 as seen in FIG. 6, into groove 78 and exiting groove 78 at the outer edge 74 of seal body 64 and outer edge 84 of cone body 80. Thus, metering is occurring. It will be understood by one skilled in the art that while the reference numerals referred to in FIG. 6 are originally applied to lower device 62, the same numbers and associated disclosure concerning its operation would apply equally to upper device 60, particularly when FIG. 6 is inverted which illustrates its proper orientation as well.

Figure 9A:
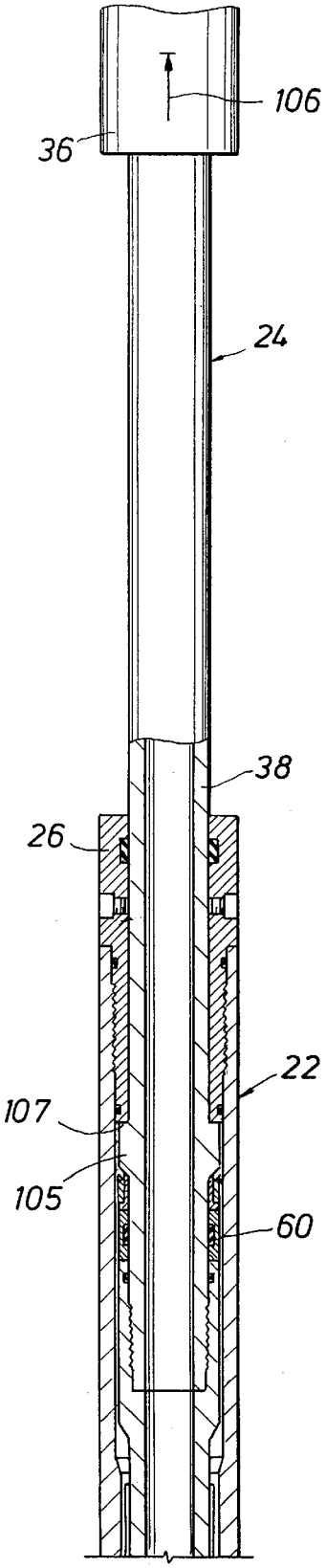
FIGS. 9A–9C are detailed fragmentary vertical cross-sectional views of the present invention shown in the final upjar position.
Figure 9B:
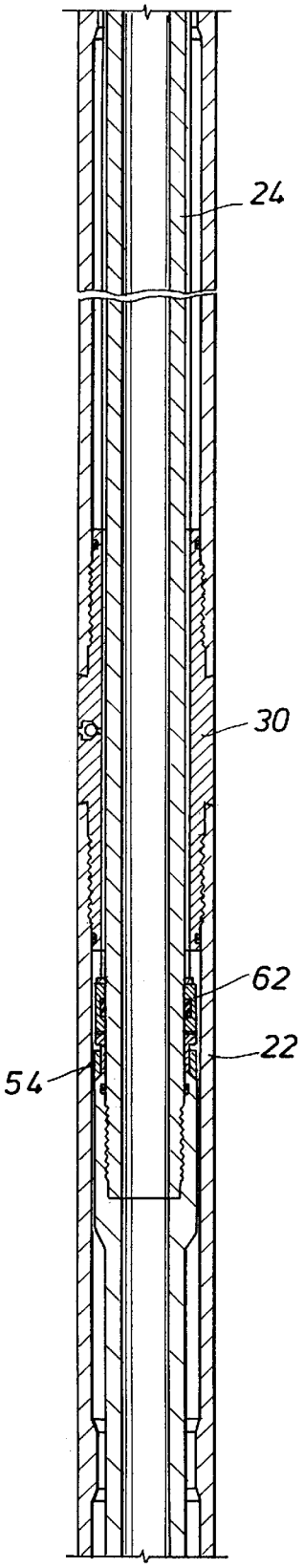
Figure 9C:
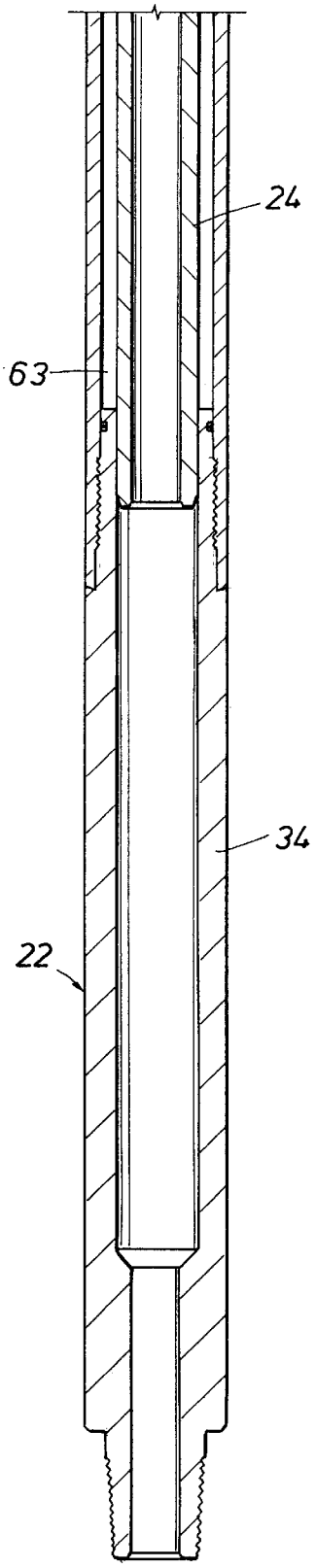

Referring now to FIGS. 8A–8C and 9A–9C, the operation of the present invention in an upward jarring action will be described in detail. With specific reference to FIGS. 8A–8C, the rig operator begins by introducing a tensile load on the coiled tubing or drill string which advances inner cylindrical assembly 24 in the direction of arrow 106. As inner cylindrical assembly 24 moves upwardly, device 62 passes through upset portion 54. However, since device 62 is in an inactive mode when moving in an upward direction relative to outer cylindrical assembly 22, it does not retard relative longitudinal movement between inner cylindrical assembly 24 and outer cylindrical assembly 22. As ring 90 of device 60 then begins to approach the edge of upset portion 52, it contacts upset portion 52 as shown by inverting FIG. 6 as discussed above. That is, contact surface 92 of ring 90 engages contact surface 88 of cone body 80 creating a seal. The pressure differential across this seal serves to force surface 94 of ring 90 against surface 53 of upset portion 52 substantially stopping or significantly retarding relative longitudinal movement between inner cylindrical assembly 24 and outer cylindrical assembly 22. At that point, as the rig operator continues to pull a tensile load up to a predetermined amount in the direction of arrow 106, the metering of hydraulic fluid occurs in the direction of arrow 100 as discussed above with respect to FIG. 6. The metering of device 60 continues as ring 90 of device 60 advances upwardly through the entire region "A" of upset portion 52. During this time period, annular space 44 is divided into an upper chamber 61 and a lower chamber 63 as discussed herein. As the operator continues to exert an upward tensile force, device 60 meters hydraulic fluid slowly from chamber 61 to chamber 63, and device 60 advances upward slowly through region "A" of upset portion 62. Since ring 90 is circular in configuration, when ring 90 reaches the end of region "A" moving in an upward direction, it cannot seal against the inner surface of upper pressure body 28. Consequently, the holding force provided by device 60 is suddenly released and protruding portion 105 (also known as a hammer) of mandrel 38 advances upwardly rapidly striking shoulder 107 of mandrel body 26, thereby providing the sudden upward jarring action or load used to free a stuck drill pipe, coiled tubing or other downhole tool. The final upward jarring position is shown in FIGS. 9A–9C.

As discussed above, the rig operator exerts a tensile load, for example in the operation of the present invention with reference to FIGS. 8A–8C and 9A–9C. The time during which a tensile load is being applied is the length of time it takes for ring 90 to advance upwardly through the entire region "A" of upset portion 52, for example. For larger jarring tools when used in conventional drilling application, a pull time on the order of about ½ of a minute is acceptable. Thus, the size and configuration of groove 78 can be modified in accordance with the spirit of this invention as disclosed herein to accommodate such a pull time requirement. In the case of coiled tubing application, the preferred pull time is in the range of 1 to 2 minutes because it takes longer for the rig operator to accurately establish the predetermined jarring load needed than in the use of a jarring tool in a conventional drill string. To provide a 1 to 2 minute pull time, the metering device of the present invention must be capable of providing up to $8\times10^6$ psi/gpm resistance to flow in the case of the 1 13/16 inch diameter coiled tubing jarring tool of the present invention, for example. Thus, the pressure differential across the inner and outer radii (edges 72 and 74) of face plate 76 of seal body 64 may be on the order of 25,000 psi and the flow rate through the groove 78 on the order of 0.75 cubic inches per minute. To achieve a resistance of $8\times10^6$ psi/gpm resistance, groove 78 in the case of coiled tubing application has a width and depth of between about 0.003 inches and 0.010 inches and a length of between about 5 and 10 inches. Consequently, to achieve such a length in coiled tubing applications, as discussed below, requires the use of a spiral or other shape cut across face plate 76.

Because of the configuration of groove 78 including its preferred geometric width, depth and length and the absence of unnecessary mechanical linkages and other elements (such as springs) commonly used in the prior art, device 60 can advance through region "A" of upset portion 52 with a compressive cocking load as low as 50 to 100 pounds for the smaller diameter coiled tubing jarring tools of the present invention, such as those having a 1 13/16 inch diameter tool. The larger coiled tubing jarring tools of the present invention, such as the 3⅛ inch diameter tool, may require a compressive cocking load of about 500–1,000 pounds to advance device 60 through region "A", with the average being approximately 500 pounds for all sized tools of the present invention. These tensile load requirements to operate the jarring tool are significantly less than the traditional loads found on state of the art jarring tools which would typically require 2,000–5,000 pounds of compressive cocking load.

As noted above, the present invention is not limited to coiled tubing application, although it is very well suited for such application. The present invention may be used in conventional drilling when the drill string or other downhole tool gets stuck.

Figure 10A:
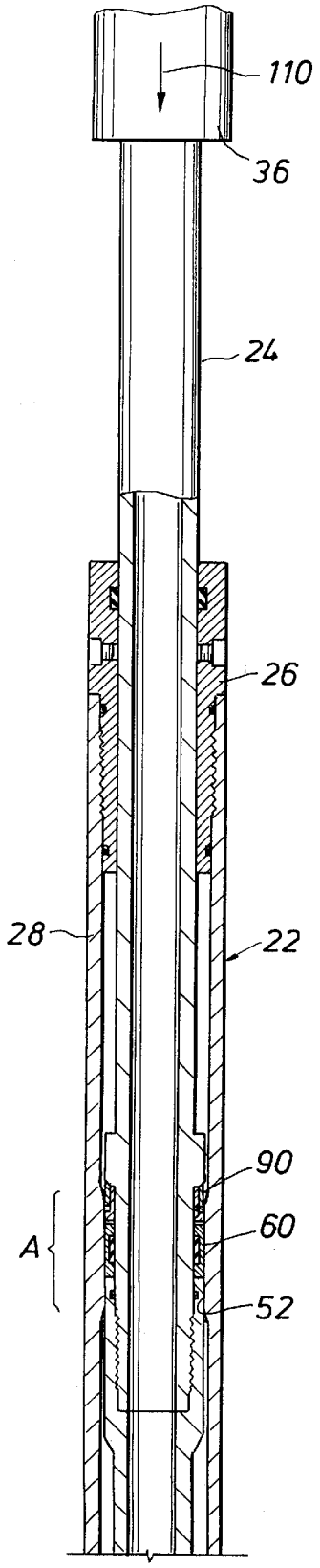
FIGS. 10A–10C are detailed fragmentary vertical cross-sectional views of the present invention shown advancing downwardly toward the position of FIGS. 8A–8C.
Figure 10B:
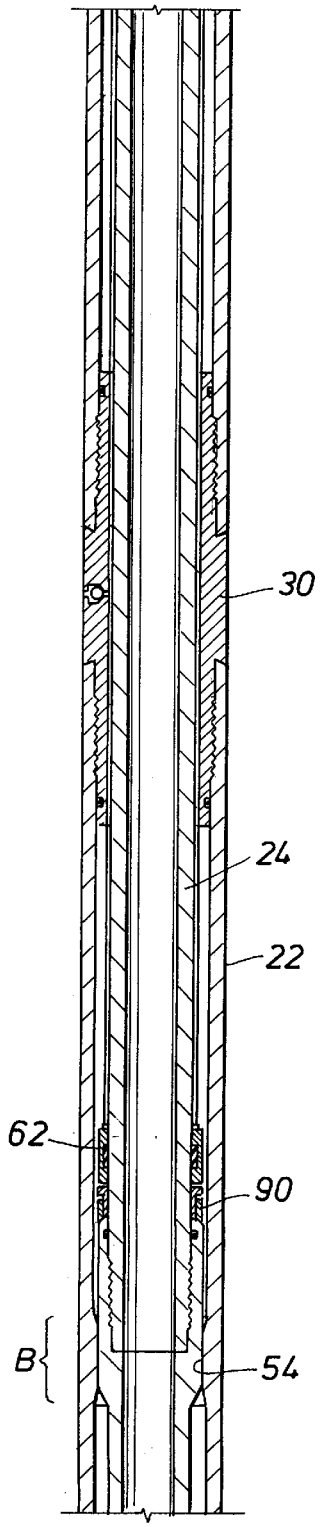
Figure 10C:
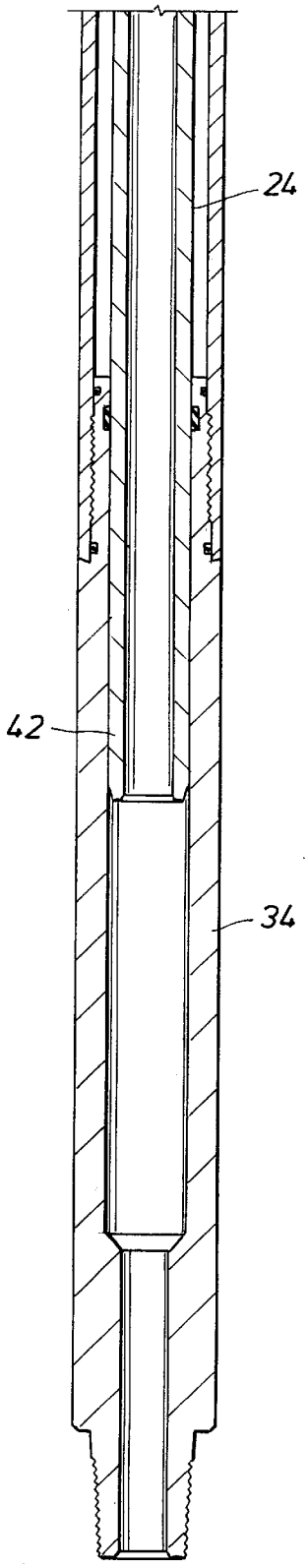

Occasionally, a single jarring action is not sufficient in either an upward or downward direction. In that event, the operator must recock the tool and repeat the process. To do so when the present invention is in the position of FIGS. 9A–9C, the rig operator simply lowers the drill pipe or coiled tubing such that inner cylindrical assembly 24 advances downwardly in the direction of arrow 110 as shown in FIGS. 10A–10C. When device 60 reaches the top of region "A" of upset portion 52 it is in an inactive position (as discussed above with respect to the inverted orientation of FIG. 7). Thus, inner cylindrical assembly 24 can be easily advanced through region "A" of upset portion 52. However, when ring 90 of device 62 first enters region "B" of upset portion 54, device 62 will immediately enter an active position as that shown and discussed above with respect to FIG. 6. In that orientation, ring 90 of device 62 immediately engages or contacts upset portion 54, thereby substantially stopping or significantly retarding relative longitudinal motion of inner cylindrical assembly 24 relative to outer cylindrical assembly 22. The rig operator, assuming he intends to introduce another upward jarring blow, would recognize a compressive load increase (a load decrease on the hook load gauge) telling him that device 62 is now entering region "B". The distance between ring 90 of device 60 and ring 90 of device 62 is selected such that ring 90 of device 60 will have passed completely through region "A" of upset portion 52 before ring 90 of device 62 first enters region "B" of upset portion 54. The rig operator would then lift up on the drill string or coiled tubing again in the manner described above with respect to FIGS. 8A–8C and begin another upward jarring action. Thus, it will be apparent to one skilled in the art based on this disclosure that the rig operator can employ the present invention to introduce a series of upward jarring actions, virtually limitless in number by cycling through the operational steps described above with respect to FIGS. 8A–8C, 9A–9C and 10A–10C, thereby rendering a series of upward jarring blows, one for each cycle until the drill string, coiled tubing or other downhole tool is freed.

As noted herein and discussed above, the present invention is a double acting jarring tool capable of providing a downward jarring action as well. Occasionally, it is also preferable to introduce a series of downward jarring actions. Sometimes it may be necessary to introduce both upward and downward depending on the circumstances. For example, if the rig operator cannot release the drill string after a number of upward jarring actions, he may elect to use downward jarring actions, or the rig operator may elect to use both upward and downward jarring actions sequentially, or just downward jarring actions. To explain the operation of the downward jarring action, reference is now made to FIGS. 10A–10C, 11A–11C and 12A–12C.

Figure 11A:
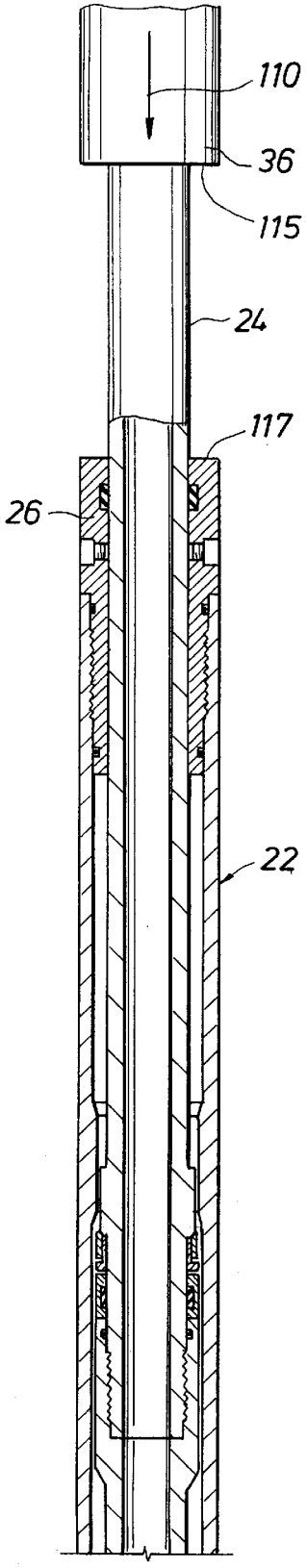
FIGS. 11A–11C are detailed fragmentary vertical cross-sectional views of the present invention with the inner cylindrical assembly at substantially the same position as that shown in FIGS. 8A–8C except that the inner cylindrical assembly is moving downwardly relative to the outer cylindrical assembly towards a downjar.
Figure 11B:
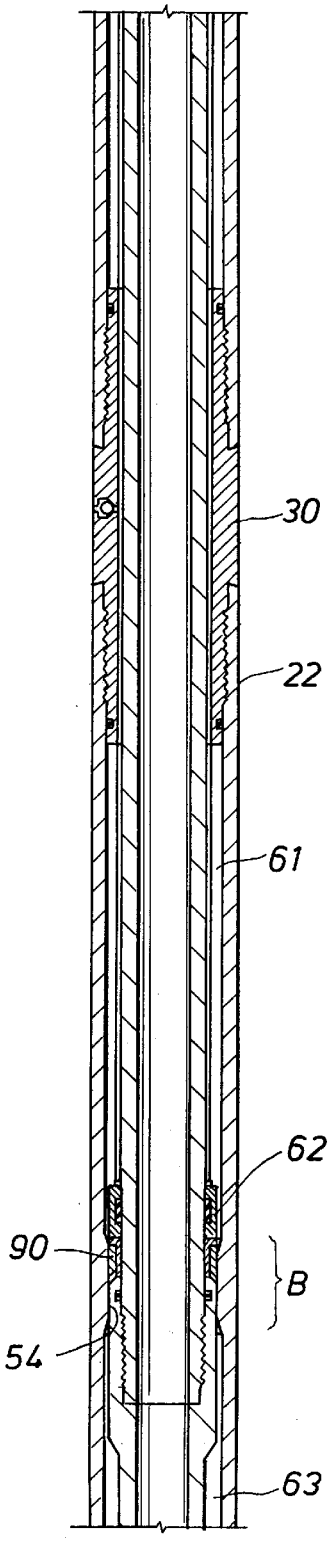
Figure 11C:
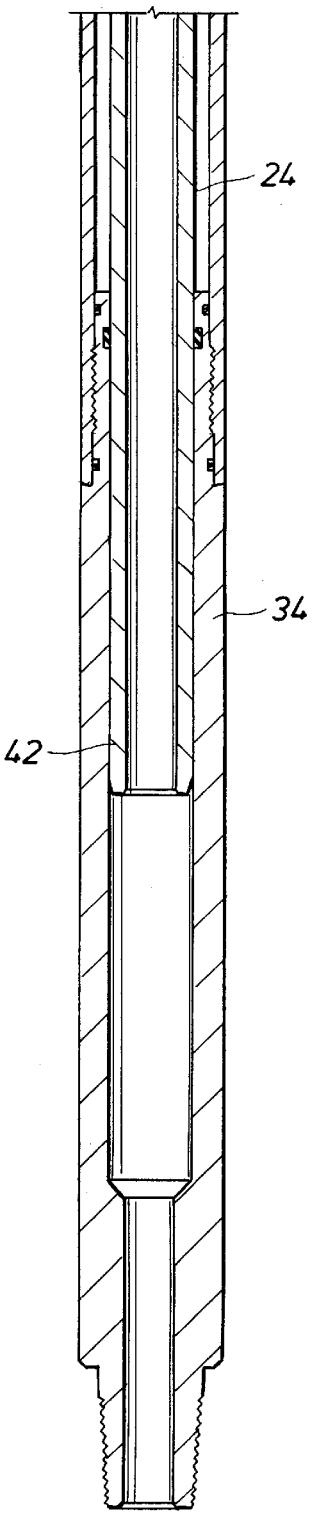
Figure 12A:
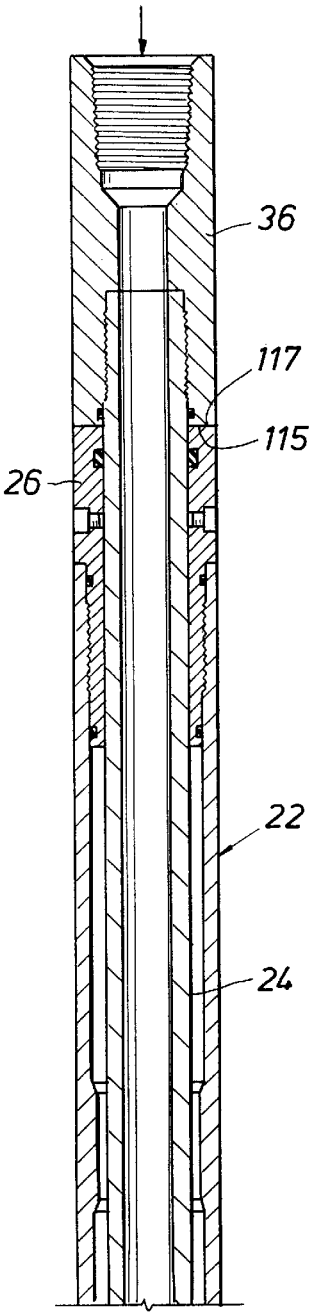
FIGS. 12A–12C are detailed fragmentary vertical cross-sectional views of the present invention in the final downjar position.
Figure 12B:
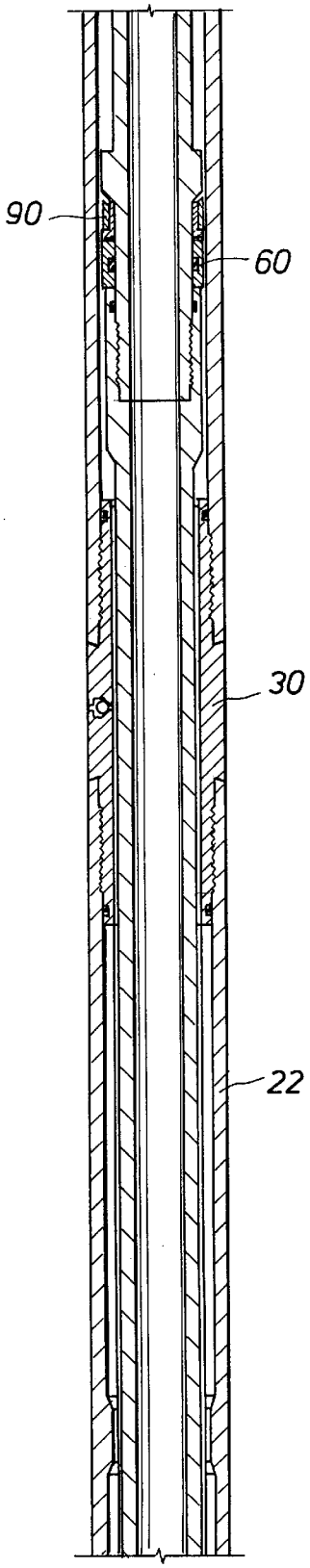
Figure 12C:
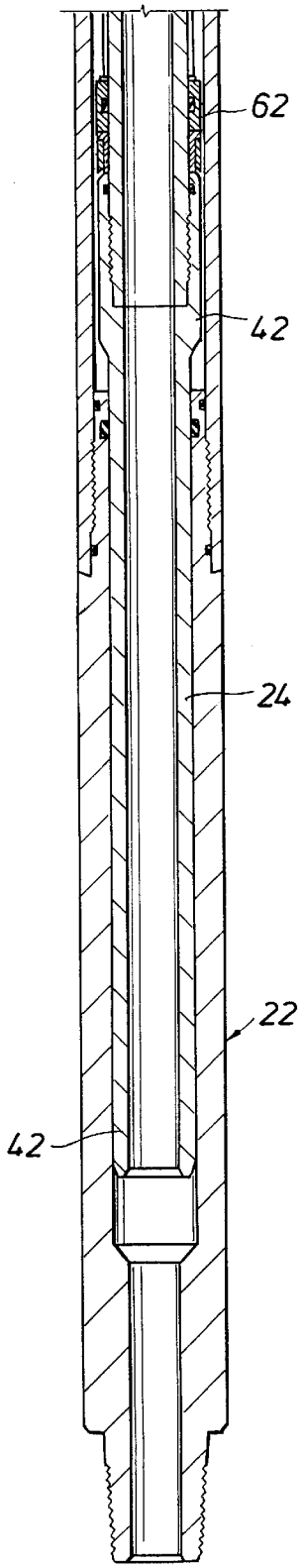

The downward jarring action may begin, for example, with the present invention in the position as shown in FIGS. 10A–10C. That is, the rig operator has completed at least one upward jarring action, or the tool is in the position shown in FIGS. 10A–10C initially. In this event, the rig operator would lower the drill string or coiled tubing thereby lowering cylindrical assembly 24 in the direction of arrow 110 as shown in FIG. 10A. As discussed above, device 60 would pass through region "A" of upset portion 52 since it is inactive in that direction, and after device 60 passes through region "A", ring 90 of device 62 would begin to contact the top edge of region "B" of upset portion 54. This initial engagement position of ring 90 of device 62 relative to the top of region "B" of upset portion 54 is shown in FIGS. 11A–11C. At this point device 62 is in the active position as shown in FIG. 6. The rig operator would immediately realize that the tool is in that position because the hook load gauge would register an increase in the compressive load required to further advance the drill string or coiled tubing, and thereby the inner cylindrical assembly 24, downwardly. If the rig operator wished to begin a downward jarring action, he would simply increase the compressive load 50 lbs. to 1,000 lbs. depending on the size of the jarring tool of the present invention as discussed above thereby providing for the metering of hydraulic fluid in the direction of arrow 100 as shown in FIG. 6 and discussed above in detail. In this position, annular space 44 has been divided into an upper chamber 61 and a lower chamber 63 (see FIG. 11B). The continued application of compressive load would advance the hydraulic fluid through the metering mechanism of the present invention as shown in FIG. 6 thereby displacing hydraulic fluid slowly from chamber 63 to chamber 61 and advancing ring 90/device 62 downwardly through region "B" of upset portion 54. At the time ring 90 reaches line "X" as shown in FIG. 6 (which is the bottom edge of upset portion 54), device 62 would immediately release inner cylindrical assembly 24 relative to outer cylindrical assembly 22 since ring 90 could not expand outwardly to engage the inner surface of lower pressure body 32. This results in the rapid descent of inner cylindrical assembly 24 relative to outer cylindrical assembly 22 until shoulder 115 of top sub 36 strikes shoulder 117 of mandrel body 26 (as shown in FIG. 12A) causing the downward jarring blow.

If the rig operator wished to repeat the downward jarring action or cause an upward jarring action, he would raise the drill string or coiled tubing thereby raising inner cylindrical assembly 24 relative to outer cylindrical assembly 22 in the direction of arrow 106 as shown in FIGS. 1A–1C. The configuration of the present invention in FIGS. 1A–1C would be the next sequential step upwardly after a downward jarring blow. In this configuration as shown in FIGS. 1A–1C, device 62 can easily pass through region "B" of upset portion 54 since it is in an inactive position in that orientation as shown in FIG. 7 and discussed above. Due to the placement of device 60 relative to device 62 compared to the placement of the lower end of region "A" of upset portion 52 relative to region "B" of upset portion 54, device 62 will pass completely through region "B" before ring 90 of device 60 enters the lower portion of region "A" of upset portion 52. At that point, the rig operator would register an increase in tensile load on the hook load gauge telling him that he is in a position of initiating either an upward jarring action or another downward jarring action. If the rig operator elects to initiate another downward jarring action, he would repeat the process discussed above with respect to FIGS. 11A–11C and 12A–12C. Once again, a number of downward jarring actions may be performed in this manner in the event a series of downward blows are required to free the stuck drill pipe, coiled tubing or other downhole tool. If the operator elected to introduce another upward jarring action immediately following a downward jarring action, he would simply continue a tensile load in the direction of arrow 106 and perform the operation discussed above with respect to FIGS. 8A–8C and 9A–9C.

Thus, it will be apparent to one skilled in the art based on this disclosure that the rig operator may perform any combination of upward and downward jarring actions, including any consecutive series of upward jarring actions followed by consecutive series of downward jarring actions or a combination of sequential upward/downward jarring actions. Since the present invention requires only a moderate tensile or compressive load to initiate a jarring action, it is particularly well suited for coiled tubing application. Additionally, since the present invention uses a single annular chamber which is divided into two chambers at most at any one time, it requires a minimal overall length which also makes it particularly well suited for coiled tubing application.

While it is not necessary, the present invention may also be used in combination with a jarring tool enhancer such as that described and claimed in copending patent application Ser. No. 08/827,831 entitled JARRING TOOL ENHANCER, which patent application is hereby incorporated by reference and made a part hereof. As disclosed therein, the enhancer is also particularly well suited for coiled tubing application. As discussed in the above-identified copending patent application, the enhancer serves to rapidly accelerate inner cylindrical assembly 24 relative to outer cylindrical assembly 22, once ring 90 of either device 60 or 62 leaves corresponding region "A" or "B" of upset portions 52 or 54 thereby significantly increasing the upward or downward jarring blow and providing more energy for the release of the stuck drill string, coiled tubing or downhole tool. If an enhancer is used, the rig operator may need to perform significantly fewer upward or downward jarring blows to release the stuck member.

The foregoing invention has been described in terms of various embodiments. Modifications and alterations to these embodiments will be apparent to those skilled in the art in view of this disclosure. It is, therefore, intended that all such equivalent modifications and variations fall within the spirit and scope of the claimed invention.

What is claimed is:

1. A well jar comprising:

inner and outer telescopingly related cylindrical assemblies movable longitudinally relative to one another and having telescopingly overlapping portions providing an annular space therebetween, each said inner and outer cylindrical assemblies having first and second ends;

first means for defining a restriction in said annular space proximate said first ends of said inner and outer cylindrical assemblies;

second means for defining a restriction in said annular space proximate said second ends of said inner and outer cylindrical assemblies;

first means for engaging said first restriction defining means and for metering the fluid in said annular space flowing past said first restriction defining means;

second means for engaging said second restriction defining means and for metering the fluid in said annular space flowing past said second restriction defining means; and said second engaging means is inactive while said first engaging means contacts said first restriction defining means and meters the fluid flowing past said first restriction defining means, and said first engaging means is inactive while said second engaging means contacts said second restriction defining means and meters the fluid flowing past said second restriction defining means.

2. The well jar of claim 1 wherein each said engaging and metering means comprises:

a first annular member having a first end and second end and positioned within the annular space, said first annular member having an inner radial edge, an outer radial edge, a face plane at the first end between said inner and outer radial edges;

a second annular member positioned within said annular space and longitudinally displaced therein from said first annular member, said second annular member having an inner radial edge and an outer radial edge and a face plane between said inner and outer radial edges of said second annular member, said face plane of said second annular member adapted to contact said face plane of said first annular member;

means for permitting fluid communication between said inner and outer radial edges of said second annular member;

said first annular member further comprising a contact surface;

a ring positioned within the annular space proximate said contact surface of said first annular member, said ring having an outer surface and a contact surface adapted to contact said contact surface of said first annular member; and means for limiting the longitudinal displacement of said ring;

wherein upon movement in the one direction of the first tubular member relative to the second tubular member and at the predetermined position of a second tubular member, said contact surface of said ring contacts said contact surface of said first annular member and said face plane of said first annular member contacts said face plane of said second annular member so as to prohibit the flow of fluid within said annular space from the inner radial edges of said first and second annular members to the outer radial edges of said first and second annular member except through said fluid communication means.

3. The well jar of claim 2 wherein said fluid communication means comprises a spiral groove on the face plane of said second annular member.

4. The well jar of claim 3 said spiral groove being between about 5 inches and about 10 inches in length.

5. The well jar of claim 4 said spiral groove being between about 6 inches and about 7 inches in length.

6. The well jar of claim 3 wherein said groove permits fluid flow at a rate between about 0.003 gallons/minute and about 0.025 gallons/minute.

7. The well jar of claim 6 wherein said groove permits fluid flow at a rate between about 0.003 gallons/minute and about 0.007 gallons/minute.

8. The well jar of claim 6 wherein said groove permits fluid flow at a rate between about 0.0046 gallons/minute and about 0.0092 gallons/minute.

9. The well jar of claim 6 wherein said groove permits fluid flow at a rate between about 0.0125 gallons/minute and about 0.025 gallons/minute.

10. The well jar of claim 3 said groove being between about 0.003 inches and about 0.010 inches in width.

11. The well jar of claim 3 said groove being between about 0.003 inches and about 0.010 inches in depth.

12. The well jar of claim 2 wherein said fluid communication means comprises a groove having a serpentine configuration.

13. The well jar of claim 2 wherein said fluid communications means comprises a groove having a spiral configuration with a gradually increasing radius of curvature from said inner radial edge to said outer radial edge of said second annular member.

14. A well jar comprising:

inner and outer telescopingly related cylindrical assemblies movable longitudinally relative to one another and having telescopically overlapping portions providing an annular space therebetween, each said inner and outer cylindrical assemblies having first and second ends;

a first narrowing member positioned within said annular space for restricting said annular space proximate said first ends of said inner and outer cylindrical assemblies;

a second narrowing member positioned within said annular space for restricting said annular space proximate said second ends of said inner and outer cylindrical assemblies;

a first body for engaging said first narrowing member so as to retard the telescoping movement of said inner cylindrical assembly relative to said outer cylindrical assembly;

a first bypass member for metering the fluid in said annular space flowing therethrough;

a second body for engaging said second narrowing member so as to retard the telescoping movement of said inner cylindrical assembly relative to said outer cylindrical assembly;

a second bypass member for metering the fluid in said annular space flowing therethrough; and said second body and said second bypass member are inactive while said first body engages said first narrowing member and said first bypass member meters the flow of fluid, and said first body and said first bypass member are inactive while said second body engages said second narrowing member and said second bypass member meters the flow of fluid.

15. The well jar of claim 14 wherein each said first and second body comprises:

an annular member positioned within the annular space having a contact surface;

a ring positioned within the annular space proximate said contact surface of said annular member, said ring having a contact surface adapted to contact said contact surface of said annular member;

wherein upon movement of said inner cylindrical assembly relative to said outer cylindrical assembly and at a predetermined position on said outer cylindrical assembly, said contact surface of said ring contacts said contact surface of said annular member retarding the movement of the inner cylindrical assembly relative to the outer cylindrical assembly.

16. The well jar of claim 14 wherein each said first and second bypass member means comprises:

a first annular member positioned within the annular space having an inner radial edge and an outer radial edge and a face plane at one end of said annular member between said inner and outer radial edges; and a second annular member positioned within said annular space and longitudinally displaced therein from said first annular member, said second annular member having an inner radial edge and an outer radial edge and a face plane between said inner and outer radial edges of said second annular member, said face plane of said second annular member substantially coplanar with, and adapted to contact, said face plane of said first annular member, said face plane of said second annular member having a groove therein extending from said inner radial edge of said second annular member to said outer radial edge of said second annular member;

wherein upon movement of said inner cylindrical assembly relative to said outer cylindrical assembly, said face plane of said first annular member contacts said face plane of said second annular member so as to prohibit the flow of fluid within said annular space from the inner radial edges of said first and second annular members to the outer radial edges of said first and second annular member except through said groove.

17. The well jar of claim 16 wherein said groove comprises a spiral configuration.

18. The well jar of claim 16 wherein said groove comprises a serpentine configuration.

19. The well jar of claim 16 wherein said groove comprises a spiral configuration having a gradually increasing radius of curvature from said inner radial edge to said outer radial edge of said second annular member.

20. A well jar comprising:

an elongated outer tubular member having first and second ends;

an elongated inner tubular member having first and second ends movable telescopically relative to said outer tubular member, said inner and outer tubular members having overlapping portions providing an annular space therebetween;

a first narrowing member positioned within said annular space for restricting said annular space proximate said first ends of said inner and outer tubular members;

a second narrowing member positioned within said annular space for restricting said annular space proximate said second ends of said inner and outer tubular members;

a first body for engaging said first narrowing member so as to retard the telescoping movement of said inner tubular member relative to said outer tubular member;

a first bypass member positioned proximate said first body for metering the fluid in said annular space flowing therethrough;

a second body for engaging said second narrowing member so as to retard the telescoping movement of said inner tubular member relative to said outer tubular member;

a second bypass member positioned proximate said second body for metering the fluid in said annular space flowing therethrough; and said second body and said second bypass member are inactive while said first body engages said first narrowing member and said first bypass member meters the flow of fluid, and said first body and said first bypass member are inactive while said second body engages said second narrowing member and said second bypass member meters the flow of fluid.

21. The well jar of claim 20 wherein each said first and second body comprises:

an annular member positioned within the annular space having a contact surface;

a ring positioned within the annular space proximate said contact surface of said annular member, said ring having a contact surface to contact said contact surface of said annular member;

wherein upon movement of said inner tubular member relative to said outer tubular member and at a predetermined position on said outer tubular member, said contact surface of said ring contacts said contact surface of said annular member retarding the movement of the inner tubular member relative to the outer tubular member.

22. The well jar of claim 20 wherein each said first and second bypass member comprises:

a first annular member positioned within the annular space having an inner radial edge and an outer radial edge and a face plane at one end of said annular member between said inner and outer radial edges;

a second annular member positioned within said annular space and longitudinally displaced therein from said first annular member, said second annular member having an inner radial edge and an outer radial edge and a face plane between said inner and outer radial edges of said second annular member, said face plane of said second annular member adapted to contact said face plane of said first annular member; and means for permitting fluid communication between said inner and outer radial edges of said second annular member;

wherein upon movement of said inner tubular member relative to said outer tubular member, said face plane of said first annular member contacts said face plane of said second annular member so as to prohibit the flow of fluid within said annular space from the inner radial edges of said first and second annular members to the outer radial edges of said first and second annular members except through said fluid communication means.

23. The well jar of claim 22 wherein said fluid communication means comprises a spiral groove on the face plane of said second annular member.

24. The well jar of claim 23 wherein said spiral groove includes a gradually increasing radius of curvature from said inner radial edge to said outer radial edge of said second annular member.

25. The well jar of claim 22 wherein said fluid communication means comprises a serpentine groove on the face plane of said second annular member.

26. A well jar comprising:

an elongated outer tubular member having first and second ends;

an elongated inner tubular member having first and second ends movable telescopically relative to said outer tubular member, said inner and outer tubular members having overlapping portions providing an annular space therebetween;

first means for defining a restriction in said annular space proximate said first ends of said inner and outer tubular members;

second means for defining a restriction in said annular space proximate said second ends of said inner and outer tubular members;

first means for engaging said first restriction defining means and for metering the fluid in said annular space flowing past said first restriction defining means;

second means for engaging said second restriction defining means and for metering the fluid in said annular space flowing past said second restriction defining means; and said second engaging means is inactive while said first engaging means contacts said first restriction defining means and meters the fluid flowing past said first restriction defining means, and said first engaging means is inactive while said second engaging means contacts said second restriction defining means and meters the fluid flowing past said second restriction defining means.

27. A well jar comprising:

an elongated outer tubular member having first and second ends;

an elongated inner tubular member movable telescopically relative to said outer tubular member, said inner and outer tubular members having overlapping portions providing an annular space therebetween;

said outer tubular member having (i) a first upset portion proximate said first end of said outer tubular member, and (ii) a second upset portion proximate said second end of said outer tubular member;

first means for engaging said first upset portion so as to retard the telescoping movement of said inner tubular member relative to said outer tubular member and for metering fluid flowing past said first upset portion;

second means for engaging said second upset portion so as to retard the telescoping movement of said inner tubular member relative to said outer tubular member and for metering fluid flowing past said second upset portion; and said second means for engaging said second upset portion is inactive while said first engaging means engages said first upset portion and meters fluid flowing past said first upset portion, and said first engaging means is inactive while said second engaging means contacts said second upset portion and meters fluid flowing past said second upset portion.

28. A well jar comprising:

an elongated outer tubular member having first and second ends;

an elongated inner tubular member having first and second ends and movable telescopically relative to said outer tubular member, said inner and outer tubular members having overlapping portions and defining an annular space therebetween;

a first seal positioned within said annular space for sealing between said inner and outer tubular members proximate said first ends of said inner and outer tubular members;

a second seal positioned within said annular space for sealing between said inner and outer tubular members proximate said second ends of said inner and outer tubular members;

said outer tubular member having (i) a first upset portion proximate said first end of said outer tubular member, and (ii) a second upset portion proximate said second end of said outer tubular member;

a first control member for engaging said first upset portion so as to retard the telescoping movement of said inner tubular member relative to said outer tubular member and for metering the flow of fluid flowing past said first upset portion;

a second control member for engaging said second upset portion so as to retard the telescoping movement of said inner tubular member relative to said outer tubular member and for metering the flow of fluid flowing past said second upset portion; and said second control member is inactive while said first control member engages said first upset portion and meters fluid flowing past said first upset portion, and said first control member is inactive while said second control member contacts said second upset portion and meters fluid flowing past said second upset portion.

29. In a telescoping tubular assembly having first and second tubular members movable longitudinally relative to one another and having telescopically overlapping portions providing an annular space therebetween, a mechanism for retarding the movement in one direction only of the first tubular member relative to the second tubular member at a predetermined position on the second tubular member, said mechanism comprising:

an annular member positioned within the annular space having a contact surface; and a ring positioned within the annular space proximate said contact surface of said annular member, said ring having a first contact surface adapted to contact said contact surface of said annular member;

wherein upon movement in the one direction of the first tubular member relative to the second tubular member and at the predetermined position of the second tubular member, said first contact surface of said ring contacts said contact surface of said annular member so that said outer surface of said ring contacting the predetermined position of the second tubular member retards the relative movement of the first tubular member relative to the second tubular member in the one direction.

30. In the tubular assembly of claim 29, said retarding mechanism further comprises a stopper member for limiting the longitudinal displacement of said ring, and said ring further comprises a second contact surface longitudinally displaced from said first contact surface of said ring so that upon relative movement in a direction opposite the one direction of the first tubular member relative to the second tubular member at a predetermined position of the second tubular member, said second contact surface of said ring contacts said stopper member yet permits the continued relative movement of said first tubular member relative to said second tubular member at the predetermined position in a direction opposite the one direction.

31. In the tubular assembly of claim 29, wherein the predetermined position on the second tubular member comprises means for reducing the cross-sectional area of the annular space.

32. In the tubular assembly of claim 29, wherein the predetermined position on the second tubular member comprises an upset portion extending into the annular space.

33. In a tubular assembly having first and second tubular members movable longitudinally relative to one another and having telescopically overlapping portions providing an annular space therebetween, a mechanism for retarding the movement in one direction only of the first tubular member relative to the second tubular member, said mechanism comprising:

an annular member positioned within the annular space having a contact surface;

means for partially restricting the cross sectional area of said annular space; and a ring positioned within the annular space adjacent said contact surface of said annular member, said ring having an outer surface and having a first contact surface adapted to contact said contact surface of said annular member, wherein upon movement in the one direction of the first tubular member relative to the second tubular member, said first contact surface of said ring contacts said contact surface of said annular member so that said outer surface of said ring contacting said partially restricting means retards the relative movement of the first tubular member relative to the second tubular member in the one direction.

34. In the tubular assembly of claim 33, said retarding mechanism further comprises a stopper member for limiting the longitudinal displacement of said ring, and said ring further comprises a second contact surface longitudinally displaced from said first contact surface of said ring so that upon relative movement in a direction opposite the one direction of the inner cylindrical assembly relative to the outer cylindrical assembly at the predetermined position of the outer cylindrical assembly, said second contact surface of said ring contacts said stopper member yet permits the continued relative movement of said inner cylindrical assembly relative to said outer cylindrical assembly at the predetermined position in a direction opposite the one direction.

35. In the tubular assembly of claim 33, said partially restricting means comprises an upset portion extending from the second tubular member into the annular space.

36. In a tubular assembly having inner and outer telescopingly related cylindrical assemblies movable longitudinally relative to one another and having telescopically overlapping portions providing an annular space therebetween, a mechanism for retarding the movement in one direction only of the inner cylindrical assembly relative to the outer cylindrical assembly at a predetermined position on the outer cylindrical assembly, said mechanism comprising:

an annular member positioned within the annular space having a contact surface;

a ring positioned within the annular space adjacent said first angular planar surface, said ring having an outer surface and having a first contact surface adapted to contact said contact surface of said annular member; and a member for limiting the longitudinal displacement of said ring within the annular space distal said annular member;

wherein upon movement in the one direction of said inner cylindrical assembly relative to said outer cylindrical assembly and at the predetermined position on the outer cylindrical assembly, said first contact surface of said ring contacts said contact surface of said annular member so that said outer surface of said ring contacting the predetermined position of the outer cylindrical assembly retards the relative movement of the inner cylindrical assembly to the outer cylindrical assembly in the one direction.

37. In the tubular assembly of claim 36 wherein said ring further comprises a second contact surface longitudinally displaced from said first contact surface of said ring so that upon relative movement in a direction opposite said one direction of the inner cylindrical assembly relative to the outer cylindrical assembly at the predetermined position of the outer cylindrical assembly, said second contact surface of said ring contacts said limiting member yet permits the continued relative movement of said inner cylindrical assembly relative to said outer cylindrical assembly at the predetermined position in a direction opposite the one direction.

38. In the tubular assembly of claim 36, wherein the predetermined position on the outer cylindrical assembly comprises means for reducing the cross sectional area of the annular space.

39. In the tubular assembly of claim 36, wherein the predetermined position on the outer cylindrical assembly comprises an upset portion extending into the annular space.

40. In a telescoping tubular assembly having first and second tubular members movable longitudinally relative to one another and having telescopingly overlapping portions providing an annular space therebetween, a mechanism for metering the flow of fluid within the annular space comprising:

a first annular member positioned within the annular space having an inner radial edge and an outer radial edge and a face plane at one end of said annular member between said inner and outer radial edges;

a second annular member positioned within said annular space and longitudinally displaced therein from said first annular member, said second annular member having an inner radial edge and an outer radial edge and a face plane between said inner and outer radial edges of said second annular member, said face plane of said second annular member adapted to contact said face plane of said first annular member; and means for permitting fluid communication between said inner and outer radial edge of said second annular member;

wherein upon movement of said first tubular member relative to said second tubular member, said face plane of said first annular member contacts said face plane of said second annular member so as to prohibit the flow of fluid within said annular space from the inner radial edges of said first and second annular members to the outer radial edges of said first and second annular member except through said fluid communication means.

41. In the tubular assembly of claim 40 wherein said fluid communication means comprises a spiral groove on the face plane of said second annular member.

42. In the tubular assembly of claim 40 wherein said fluid communication means comprises a serpentine groove on the face plane of said second annular member.

43. In the tubular assembly of claim 40 wherein said fluid communication means comprises a spiral groove having a gradually increasing radius of curvature from said inner radial edge to said outer radial edge of said second annular member.

44. In the tubular assembly of claim 41 said spiral groove being between about 5 inches and about 10 inches in length.

45. In the tubular assembly of claim 44 said spiral groove being between about 6 inches and about 7 inches in length.

46. In the tubular assembly of claim 41 wherein said groove permits fluid flow at a rate between about 0.003 gallons/minute and about 0.025 gallons/minute.

47. In the tubular assembly of claim 46 wherein said groove permits fluid flow at a rate between about 0.003 gallons/minute and about 0.007 gallons/minute.

48. In the tubular assembly of claim 46 wherein said groove permits fluid flow at a rate between about 0.0046 gallons/minute and about 0.0092 gallons/minute.

49. In the tubular assembly of claim 46 wherein said groove permits fluid flow at a rate between about 0.0125 gallons/minute and about 0.025 gallons/minute.

50. In the tubular assembly of claim 41 said groove being between about 0.003 inches and about 0.010 inches in width.

51. In the tubular assembly of claim 50 said groove being preferably between about 0.003 inches and about 0.004 inches in width.

52. In the tubular assembly of claim 41 said groove being between about 0.003 inches and about 0.010 inches in depth.

53. In the tubular assembly of claim 52 wherein said groove being preferably between about 0.003 inches and about 0.004 inches in depth.

54. In a telescoping tubular assembly having first and second tubular members movable longitudinally relative to one another and having telescopically overlapping portions providing an annular space therebetween, a mechanism for retarding the movement in one direction only of the first tubular member relative to the second tubular member at a predetermined position on the second tubular member, said mechanism comprising:

an annular member positioned within the annular space having a contact surface;

a ring positioned within the annular space proximate said contact surface of said annular member, said ring having an outer surface and first contact surface adapted to contact said contact surface of said annular member; and a stopper member for limiting the longitudinal displacement of said ring;

wherein upon movement in the one direction of the first tubular member relative to the second tubular member and at the predetermined position of the second tubular member, said first contact surface of said ring contacts said contact surface of said annular member so that said outer surface of said ring contacting the predetermined portion of the second tubular member retards the relative movement of the first tubular member relative to the second tubular member in the one direction.

55. In the tubular assembly of claim 54 wherein said ring further comprises a second contact surface longitudinally displaced from said first contact surface of said ring so that upon relative movement in a direction opposite the one direction of the first tubular member relative to the second tubular member at the predetermined position of the second tubular member, said second contact surface of said ring contacts at least a portion of said stopper member yet permits the continued movement of said first tubular member relative to said second tubular member at the predetermined position in a direction opposite the one direction.

56. In a telescoping tubular assembly having first and second tubular members movable longitudinally relative to one another and having telescopingly overlapping portions providing an annular space therebetween, a mechanism for metering the flow of fluid within the annular space and for retarding the movement in one direction only of the first tubular member relative to the second tubular member at a predetermined position on the second tubular member, said mechanism comprising:

a first annular member having a first end and second end and positioned within the annular space, said first annular member having an inner radial edge, an outer radial edge, a face plane at said first end of said first annular member between said inner and outer radial edges;

a second annular member positioned within said annular space and longitudinally displaced therein from said first annular member, said second annular member having an inner radial edge and an outer radial edge and a face plane between said inner and outer radial edges of said second annular member, said face plane of said second annular member being adapted to contact said face plane of said first annular member, said face plane of said second annular member having a groove therein extending from said inner radial edge of said second annular member to said outer radial edge of said second annular member to meter the flow of fluid within the annular space;

said first annular member further comprising a contact surface;

a ring positioned within the annular space proximate said contact surface of said first annular member, said ring having a first contact surface and adapted to contact said contact surface of said annular member; and means for limiting the longitudinal displacement of said ring;

wherein upon movement in the one direction of the first tubular member relative to the second tubular member and at the predetermined position of the second tubular member, said first contact surface of said ring contacts said contact surface of said first annular member and said face plane of said first annular member contacts said face plane of said second annular member so as to prohibit the flow of fluid within said annular space from the inner radial edges of said first and second annular members to the outer radial edges of said first and second annular member except through said groove.

57. In the tubular assembly of claim 56 wherein said groove comprises a spiral configuration.

58. In the tubular assembly of claim 57 said groove being between about 5 inches and about 10 inches in length.

59. In the tubular assembly of claim 58 said groove being between about 6 inches and about 7 inches in length.

60. In the tubular assembly of claim 56 wherein said groove comprises a serpentine configuration.

61. In the tubular assembly of claim 56 wherein said groove comprises a spiral configuration having a gradually increasing radius of curvature from said inner radial edge to said outer radial edge of said second annular member.

* * * * *